US008650926B2

(12) United States Patent
Yamamoto et al.

(10) Patent No.: US 8,650,926 B2
(45) Date of Patent: Feb. 18, 2014

(54) EXTRUSION PRESS AND EXTRUSION CONTROL METHOD

(75) Inventors: Takeharu Yamamoto, Yamaguchi (JP); Atsushi Yakushigawa, Yamaguchi (JP)

(73) Assignee: Ube Machinery Corporation, Ltd. (JP)

( * ) Notice: Subject to any disclaimer, the term of this patent is extended or adjusted under 35 U.S.C. 154(b) by 602 days.

(21) Appl. No.: 12/523,072

(22) PCT Filed: Jan. 7, 2008

(86) PCT No.: PCT/JP2008/050225

§ 371 (c)(1),
(2), (4) Date: Jul. 14, 2009

(87) PCT Pub. No.: WO2008/087891

PCT Pub. Date: Jul. 24, 2008

(65) Prior Publication Data

US 2010/0000283 A1 Jan. 7, 2010

(30) Foreign Application Priority Data

Jan. 15, 2007 (JP) ..... 2007-005388
May 28, 2007 (JP) ..... 2007-139986

(51) Int. Cl.
*B21C 31/00* (2006.01)
*B21C 27/00* (2006.01)

(52) U.S. Cl.
USPC ..... 72/271; 72/272

(58) Field of Classification Search
USPC ..... 72/272, 273, 264, 265, 266, 253.1, 271, 72/31.13
See application file for complete search history.

(56) References Cited

U.S. PATENT DOCUMENTS

| | | | |
|---|---|---|---|
| 3,675,451 | A | 7/1972 | Aisenberg et al. |
| 5,062,285 | A | 11/1991 | Groos |
| 5,454,250 | A | 10/1995 | Ikeda et al. |
| 6,153,131 | A | 11/2000 | Huang et al. |
| 7,124,491 | B2 | 10/2006 | Toeniskoetter et al. |

FOREIGN PATENT DOCUMENTS

| | | | |
|---|---|---|---|
| CN | 2309906 | Y | 3/1999 |
| CN | 2351224 | Y | 12/1999 |
| CN | 2485064 | Y | 4/2002 |
| DE | 39 37 276 | C1 | 1/1991 |
| JP | 58-020323 | A | 2/1983 |
| JP | 4-274821 | A | 9/1992 |
| JP | 10-314833 | * | 12/1998 |
| JP | 10-314833 | A | 12/1998 |
| JP | 2003-220409 | A | 8/2003 |

* cited by examiner

*Primary Examiner* — Dana Ross
*Assistant Examiner* — Mohammad I Yusuf
(74) *Attorney, Agent, or Firm* — DLA Piper LLP (US)

(57) ABSTRACT

An extrusion press and an extrusion control method obtains a uniformly-shaped extruded product by constantly applying a constant container sealing force between a container and a die even when an extrusion force varies during an extrusion process, improving product yield, and keeping a small energy consumption at the time of extrusion.

7 Claims, 11 Drawing Sheets

(a)

(b)

EXTRUSION PRESS AND EXTRUSION CONTROL METHOD

CROSS-REFERENCE TO RELATED APPLICATIONS

The present invention claims priority of Japanese Patent Application No. 2007-005388 filed on Jan. 15, 2007 and Japanese Patent Application No. 2007-139986 filed on May 28, 2007 and the contents are incorporated herein as reference and continued in the subject application.

BACKGROUND OF THE INVENTION

1. Field of the Invention

The present invention relates to an extrusion press and an extrusion control method and, more particularly, to an extrusion press and an extrusion control method capable of improving the product yields by controlling a container sealing force that acts on the end surface of a die to be constant during the entire process of extrusion.

2. Description of the Related Art

A conventional extrusion press comprises an end platen linked to a tie rod and a main cylinder device and on the side of the end platen, a container is arranged, in which a billet is loaded, with a die being sandwiched in between, and on the side of the main cylinder device, a stem is provided to a crosshead to be driven integrally with a main ram that enters/exits from the main cylinder. Then, the billet loaded in the container is extruded under pressure by the stem using the extrusion force by the main cylinder device and thus a predetermined product is extruded and molded from a die.

In such an extrusion press, it is desirable that the container sealing force be constant during the entire extrusion process, however, the billet in the container gradually becomes shorter and shorter in the extrusion process, and therefore, normally the force required for extrusion when extrusion starts is larger than that when extrusion ends. That is, even if the extrusion resistance of a die (required extrusion force that acts on a die) is constant, the frictional resistance between the container inner wall and the billet becomes smaller as the length of the billet is reduced, and therefore, the extrusion force gradually reduces on the whole.

If the extrusion force changes during the extrusion process, the force that acts on the die of the extrusion press changes, and as a result the amount of deflection of the die is not constant during the extrusion process. Consequently, there is a problem that the product obtained by a conventional extrusion press is not uniform in thickness and shape in the longitudinal direction.

Further, the change in the extrusion force causes the container sealing force against the die to vary and there used to be a problem of the occurrence of a so-called bursting phenomenon, in which the billet bursts forth from a sealed part.

In the extrusion press disclosed in Japanese Unexamined Patent Publication (Kokai) No. 4-274821, a pressing means for pressing under pressure a container to the side of a die so as to seal between the container and the die is provided to a crosshead that links a main cylinder device and a main ram. Then, when the length of a billet becomes equal to or less than a predetermined length during extrusion process, the container is pressed under pressure with the pressing means and a container seal force is applied between the container and the die by the pressing pressure, and thereby, the burst of the billet is avoided (patent document 1).

However, with the technique disclosed in above-described patent document 1, the container sealing force applied to the end platen via the die is added to cause the extrusion force to act and it is possible to keep constant the displacement of the end platen and the die in the longitudinal direction of extrusion of a product and to obtain a uniform product, however, during the extrusion process, the container is pressed under pressure by the pressing means, and therefore, there is a problem that a maximum load pressure when extrusion starts acts on the main cylinder device and the amount of energy consumption increases during extrusion process.

[Patent document 1] Japanese Unexamined Patent Publication (Kokai) No. 4-274821.

SUMMARY OF THE INVENTION

The present invention has been developed in order to solve the problem and an object thereof is to provide an extrusion press and an extrusion control method capable of: obtaining a uniformly-shaped product by constantly applying a constant container sealing force between a container and a die even when an extrusion force varies during extrusion process, improving the product yields, and keeping a small energy consumption at the time of extrusion.

In order to achieve the above-mentioned object, an extrusion press according to a first aspect of the present invention is characterized by comprising a container moving means for moving a container at an end platen and molding a product by extruding a billet loaded in the container from a die by a stem of a main cylinder device, wherein a hydraulic pressure of the main cylinder device is detected, a deviation between the detected hydraulic pressure and a reference pressure set in advance is mathematically processed, and the extrusion press comprises a control means, which is capable of sending an output to the container moving means to reduce a container sealing force when the deviation is plus with respect to the reference pressure, or to increase the container sealing force when the deviation is minus with respect to the reference pressure, so that a container sealing force corresponding to the reference pressure acts on the end surface of the die.

An extrusion press according to a second aspect of the present invention is characterized by comprising a container moving means for moving a container at an end platen and molding a product by extruding a billet loaded in the container from a die by a stem of a main cylinder device, wherein a container drive means that reduces a pressing force that acts on the end surface of the die is provided at the end platen, a hydraulic pressure of the main cylinder device is detected, a deviation between the detected hydraulic pressure and a reference pressure set in advance is mathematically processed, and wherein the extrusion press comprises a control means capable of sending an output to the container drive means to reduce a container sealing force when the deviation is plus with respect to the reference pressure and a control means capable of sending an output to the container moving means to increase the container sealing force when the deviation is minus with respect to the reference pressure, so that a container sealing force corresponding to the reference pressure acts on the end surface of the die.

An extrusion press according to a third aspect of the present invention is characterized in that the container drive means provided at the end platen to reduce a container sealing force that acts on an end surface of a die comprises a hydraulic cylinder in the invention of the second aspect.

An extrusion control method according to a fourth aspect of the present invention is characterized by detecting a hydraulic pressure of a main cylinder device in an extrusion process of an extrusion press, mathematically processing a deviation between the detected hydraulic pressure and a reference pressure set in advance, and performing a constant pressure extrusion by sending an output to a container moving means to reduce a container sealing force when the deviation is plus with respect to the reference pressure, or to increase the container sealing force when the deviation is minus with respect to the reference pressure, so that a container sealing force corresponding to the reference pressure acts on the end surface of the die.

An extrusion control method according to a fifth aspect of the present invention is characterized by detecting a hydraulic pressure of a main cylinder device in an extrusion process of an extrusion press, mathematically processing a deviation between the detected hydraulic pressure and a reference pressure set in advance, and performing a constant pressure extrusion by sending an output to a container drive means provided in a container to reduce a container sealing force when the deviation is plus with respect to the reference pressure, or by sending an output to a container moving means to increase the container sealing force when the deviation is minus with respect to the reference pressure, so that a container sealing force corresponding to the reference pressure acts on the end surface of the die.

An extrusion control method according to a sixth aspect of the present invention is characterized by detecting a hydraulic pressure of a main cylinder device in an extrusion process of an extrusion press, mathematically processing a deviation between the detected hydraulic pressure and a reference pressure set in advance, and performing a constant pressure extrusion by sending an output to a container drive means and a container moving means provided in a container to reduce a container sealing force when the deviation is plus with respect to the reference pressure, or by sending an output to the container moving means to increase the container sealing force when the deviation is minus with respect to the reference pressure, so that a container sealing force corresponding to the reference pressure acts on the end surface of the die.

An extrusion press according to a seventh aspect of the present invention is characterized by comprising a container moving means for moving a container at an end platen and molding a product by extruding a billet loaded in the container from a die by a stem driven by a main cylinder device, wherein the extrusion press comprises a deflection amount detection means that detects a deflection amount of the die, a deflection amount of the die during extrusion is detected, a deviation between the detected deflection amount and a reference deflection amount of the die set in advance is mathematically processed, and wherein the extrusion press comprises a control means, which is capable of sending an output to the container moving means to reduce a container sealing force when the deviation is minus, or to increase the container sealing force when the deviation is plus, so that a container sealing force corresponding to the reference deflection amount acts on the end surface of the die.

An extrusion press according to an eighth aspect of the present invention is characterized by comprising a container moving means at an end platen and molding a product by extruding a billet loaded in the container from a die by a stem driven by a main cylinder device, wherein the extrusion press comprises a container drive means that reduces a container sealing force that acts on the end surface of the die and is provided at the end platen and a deflection amount detection means that detects a deflection amount of the die, a deflection amount of the die during extrusion is detected, a deviation between the detected deflection amount and a reference deflection amount of the die set in advance is mathematically processed, and wherein the extrusion press comprises a control means capable of sending an output to the container drive means to reduce the container sealing force when the deviation is minus and a control means capable of sending an output to the container moving means to increase the container sealing force when the deviation is plus, so that a container sealing force corresponding to the reference deflection amount acts on the end surface of the die.

An extrusion press according to a ninth aspect of the present invention is characterized in that the container drive means provided at the end platen to reduce the container sealing force that acts on the end surface of the die comprises an electric servomotor and a ball screw converter including a screw shaft and a ball nut to convert a rotational motion of the output shaft of the electric servomotor into a linear motion, in the invention of the second or eighth aspect.

An extrusion press according to a tenth aspect of the present invention is characterized in that the container drive means provided at the end platen to reduce the container sealing force that acts on the end surface of the die comprises a hydraulic cylinder, in the invention of the eight aspect.

An extrusion control method for an extrusion press according to an eleventh aspect of the present invention is characterized by comprising a container moving means for moving a container at an end platen and molding a product by extruding a billet loaded in the container from a die by a stem driven by a main cylinder device and by comprising the steps of: detecting a deflection amount of the die during extrusion process of an extrusion press; mathematically processing a deviation between the detected deflection amount and a reference deflection amount set in advance; and performing a constant pressure extrusion by sending an output to the container moving means to reduce a container sealing force when the deviation is minus, or to increase the container sealing force when the deviation is plus, so that a container sealing force corresponding to the reference deflection amount acts on the end surface of the die.

An extrusion control method for an extrusion press according to a twelfth aspect of the present invention is characterized by comprising a container moving means for moving a container at an end platen and molding a product by extruding a billet loaded in the container from a die by a stem driven by a main cylinder device and by comprising the steps of: detecting a deflection amount of the die during extrusion process of an extrusion press; mathematically processing a deviation between the detected deflection amount and a reference deflection amount set in advance; and performing a constant pressure extrusion by sending an output to a container drive means to reduce a container sealing force when the deviation is minus, or by sending an output to the container moving means to increase the container sealing force when the deviation is plus, so that a container sealing force corresponding to the reference deflection amount acts on the end surface of the die.

An extrusion control method according to a thirteenth aspect of the present invention is characterized by comprising the steps of: detecting a deflection amount of the die during extrusion process of an extrusion press; mathematically processing a deviation between the detected deflection amount and a reference deflection amount set in advance; and performing a constant pressure by sending an output to a container moving means and a container drive means provided at an end platen to reduce a container sealing force when the deviation is minus, or by sending an output to the container moving means to increase the container sealing force when the deviation is plus, so that a container sealing force corresponding to the reference deflection amount acts on the end surface of the die, in the invention of the twelfth aspect.

ADVANTAGEOUS EFFECTS OF THE INVENTION

As described above, in the extrusion press according to the first aspect of the present invention, the hydraulic pressure of the main cylinder device is detected and a deviation between the detected hydraulic pressure and a reference pressure set in advance is mathematically processed. Then, the press comprises the control means, which sends an output to the container moving means to reduce the container sealing force when the deviation is plus with respect to the reference pressure, or to increase the container sealing force when the deviation is minus with respect to the reference pressure, so that a container sealing force corresponding to the reference pressure acts on the end surface of the die. The reference pressure is set, in advance, in a range lower than a maximum extrusion load pressure and higher than a required extrusion load pressure that acts on the die.

Due to this, it is possible to correct and keep constant the container sealing force that acts on the die during the entire extrusion process. Because of this, it is possible to keep constant the amount of displacement and deflection of the die and the thickness and shape of the product become uniform in the longitudinal direction, and therefore, the product yields are improved. In addition, it is possible to increase the container sealing force of the die without increasing the load pressure of the main cylinder device, and therefore, it is unlikely that the amount of energy consumption is increased.

In the extrusion press according to the second aspect of the present invention, the container drive means that reduces the container sealing force that acts on the end surface of the die is provided at the end platen, the hydraulic pressure of the main cylinder device is detected, and a deviation between the detected hydraulic pressure and the reference pressure set in advance is mathematically processed. Then, the press comprises the control means that sends an output to the container drive means to reduce the container sealing force when the deviation is plus with respect to the reference pressure and the control means that sends an output to the container moving means to increase the container sealing force when the deviation is minus with respect to the reference pressure, so that a container sealing force corresponding to the reference pressure acts on the end surface of the die.

Due to this, it is possible to correct and keep constant the container sealing force that acts on the die during the entire extrusion process. Because of this, it is possible to keep constant the amount of displacement and deflection of the die and the thickness and shape of the product become uniform in the longitudinal direction, and therefore, the product yields are improved. In addition, it is possible to make constant the container sealing force that acts on the die without increasing the load pressure of the main cylinder device, and therefore, it is unlikely that the amount of energy consumption is increased.

In the extrusion press according to the third aspect of the present invention, the drive means provided at the end platen of the extrusion press according to the second aspect to reduce the container sealing force that acts on the end surface of the die is comprises of a hydraulic cylinder. Due to this, it is possible to make constant the container sealing force that acts on the die without increasing the load pressure of the main cylinder device and, at the same time, to minimize the size of the drive means and make the extrusion press compact.

In the extrusion control method according to the fourth aspect of the present invention, the hydraulic pressure of the main cylinder device is detected in the extrusion process of the extrusion press. Then, a deviation between the detected hydraulic pressure and the reference pressure set in advance is mathematically processed, and an output is sent from the control means to the container moving means to reduce the container sealing force when the deviation is plus with respect to the reference pressure, or to increase the container sealing force when the deviation is minus with respect to the reference pressure, so that a container sealing force corresponding to the reference pressure acts on the end surface of the die. The reference pressure is set, in advance, in a range lower than a maximum extrusion load pressure and higher than a required extrusion load pressure that acts on the die.

Due to this, it is possible to correct and keep constant the container sealing force that acts on the die during the entire extrusion process. Because of this, it is possible to keep constant the amount of displacement and deflection of the die and the thickness and shape of the product become uniform in the longitudinal direction, and therefore, the product yields are improved. In addition, it is possible to make constant the container sealing force that acts on the die without increasing the load pressure of the main cylinder device, and therefore, it is unlikely that the amount of energy consumption is increased.

In the extrusion control method according to the fifth aspect of the present invention, the drive means that reduces the container sealing force that acts on the end surface of the die is provided in the container, the hydraulic pressure of the main cylinder device is detected, and a deviation between the detected hydraulic pressure and the reference pressure set in advance is mathematically processed. Then, an output is sent from a control means to the container drive means to reduce the container sealing force when the deviation is plus with respect to the reference pressure, or an output is sent from a control means to the container moving means to increase the container sealing force when the deviation is minus with respect to the reference pressure, so that a container sealing force corresponding to the reference pressure acts on the end surface of the die.

Due to this, it is possible to correct and keep constant the container sealing force that acts on the die during the entire extrusion process. Because of this, it is possible to keep constant the amount of displacement and deflection of the die and the thickness and shape of the product become uniform in the longitudinal direction, and therefore, the product yields are improved. In addition, it is possible to apply a pressing force to the die without increasing the load pressure of the main cylinder device, and therefore, it is unlikely that the amount of energy consumption is increased.

In the extrusion control method according to the sixth aspect of the present invention, the drive means that reduces the container sealing force that acts on the end surface of the die is provided in the container, the hydraulic pressure of the main cylinder device is detected, and a deviation between the detected hydraulic pressure and the reference pressure set in advance is mathematically processed. Then, an output is sent from the control means to the container moving means and drive means of the container to reduce the container sealing force when the deviation is plus with respect to the reference pressure, or an output is sent from the control means to the container moving means to increase the container sealing force when the deviation is minus with respect to the reference pressure so that a container sealing force corresponding to the reference pressure acts on the end surface of the die.

Due to this, it is possible to correct with high precision and keep constant the container sealing force that acts on the die during the entire extrusion process. Because of this, it is possible to keep constant the amount of displacement and deflection of the die and the thickness and shape of the product become uniform in the longitudinal direction, and therefore, the product yields are improved. In addition, it is possible to apply a pressing force to the die without increasing the load pressure of the main cylinder device, and therefore, it is unlikely that the amount of energy consumption is increased.

In the extrusion press according to the seventh aspect of the present invention, the means to detect the deflection amount of the die is provided, a deflection amount of the die is detected, and a deviation between the detected deflection amount and the reference deflection amount set in advance is mathematically processed. Then, the press comprises the control means, which sends an output to the container moving means to increase the container sealing force when the deviation is plus, i.e., the deflection amount is larger than the reference deflection amount, or to reduce the container sealing force when the deviation is minus, that is, the deflection amount is smaller than the reference deflection amount, so that a container sealing force corresponding to the reference deflection amount acts on the end surface of the die.

Due to this, it is possible to correct and keep constant the container sealing force that acts on the die during the entire extrusion process. Because of this, it is possible to keep constant the amount of deflection of the die and the thickness and shape of the product become uniform in the longitudinal direction, and therefore, the product yields are improved. In addition, it is possible to increase the container sealing force that acts on the die without increasing the load pressure of the main cylinder device, and therefore, it is unlikely that the amount of energy consumption is increased.

In the extrusion press according to the eighth aspect of the present invention, the container drive means to reduce the container sealing force and the means to detect the deflection amount of the die are provided, a deflection amount of the die is detected, and a deviation between the detected deflection amount and the reference deflection amount set in advance is mathematically processed. Then, the control means that sends an output to the container drive means to reduce the container sealing force when the deviation is minus, i.e., the deflection amount is smaller than the reference deflection amount and the control means that sends an output to the container moving means to increase the container sealing force when the deviation is plus, i.e., the deflection amount is larger than the reference deflection amount are provided so that a container sealing force corresponding to the reference deflection amount acts on the end surface of the die.

Due to this, it is possible to correct and keep constant the container sealing force that acts on the die during the entire extrusion process. Because of this, it is possible to keep constant the amount of deflection of the die and the thickness and shape of the product become uniform in the longitudinal direction, and therefore, the product yields are improved. In addition, it is possible to increase the container sealing force that acts on the die without increasing the load pressure of the main cylinder device, and therefore, it is unlikely that the amount of energy consumption is increased.

In the extrusion press according to the ninth aspect of the present invention, the container drive means provided at the end platen of the extrusion press according to the second or eight aspect to reduce the container sealing force that acts on the end surface of the die adopts a configuration that uses an electric servomotor and a ball screw converter comprised of a screw shaft and a ball nut to convert the rotational motion of the output shaft of the electric servomotor into a linear motion.

Due to this, the energy efficiency is improved and the container sealing force can be reduced with a small amount of energy consumption.

In the extrusion press according to the tenth aspect of the present invention, the container drive means provided at the end platen of the extrusion press according to the eight aspect to reduce the container sealing force that acts on the end surface of the die adopts a configuration that uses a hydraulic cylinder.

Due to this it is possible to minimize the size of the drive means and reduce the container sealing force.

In the extrusion control method according to the eleventh aspect of the present invention, a deflection amount of the die during extrusion process is detected and a deviation between the detected deflection amount and the reference deflection amount set in advance is mathematically processed. Then, an output is sent to the container moving means to increase the container sealing force when the deviation is plus, i.e., the deflection amount is larger than the reference deflection amount, or to reduce the container sealing force when the deviation is minus, i.e., the deflection amount is smaller than the reference deflection amount so that a container sealing force corresponding to the reference deflection amount acts on the end surface of the die.

Due to this, it is possible to correct and keep constant the container sealing force that acts on the die during the entire extrusion process. Because of this, it is possible to keep constant the amount of deflection of the die and the thickness and shape of the product become uniform in the longitudinal direction, and therefore, the product yields are improved. In addition, it is possible to increase the container sealing force that acts on the die without increasing the load pressure of the main cylinder device, and therefore, it is unlikely that the amount of energy consumption is increased.

In the extrusion control method according to the twelfth aspect of the present invention, a deflection amount of the die during extrusion process is detected and a deviation between the detected deflection amount and the reference deflection amount set in advance is mathematically processed. Then, an output is sent to the container moving means provided at the end platen to reduce the container sealing force when the deviation is minus, i.e., the deflection amount is smaller than the reference deflection amount, or an output is sent to the container moving means to increase the container sealing force when the deviation is plus, i.e., the deflection amount is larger than the reference deflection amount so that a container sealing force corresponding to the reference deflection amount acts on the end surface of the die.

Due to this, it is possible to correct and keep constant the container sealing force that acts on the die during the entire extrusion process. Because of this, it is possible to keep constant the amount of displacement and deflection of the die and the thickness and shape of the product become uniform in the longitudinal direction, and therefore, the product yields are improved. In addition, it is possible to increase the container sealing force that acts on the die without increasing the load pressure of the main cylinder device, and therefore, it is unlikely that the amount of energy consumption is increased.

In the extrusion control method according to the thirteenth aspect of the present invention, when the deviation is minus, that is, the deflection amount is smaller than the reference deflection amount, an output is sent to the container drive means and the container moving means provided at the end platen to reduce the container sealing force in the extrusion control method of the twelfth aspect.

Due to this, it is possible to correct and keep constant the container sealing force that acts on the die during the entire extrusion process. Because of this, it is possible to keep constant the amount of deflection of the die and the thickness and shape of the product become uniform in the longitudinal direction, and therefore, the product yields are improved. In addition, it is possible to increase the container sealing force that acts on the die without increasing the load pressure of the main cylinder device, and therefore, it is unlikely that the amount of energy consumption is increased.

The present invention may be fully understood by the description of the preferred embodiments of the present invention in conjunction with the accompanying drawings.

DESCRIPTION OF THE PREFERRED EMBODIMENTS

Embodiments of an extrusion press and an extrusion control method according to the present invention are explained below in detail with reference to the drawings.

Figure 1:
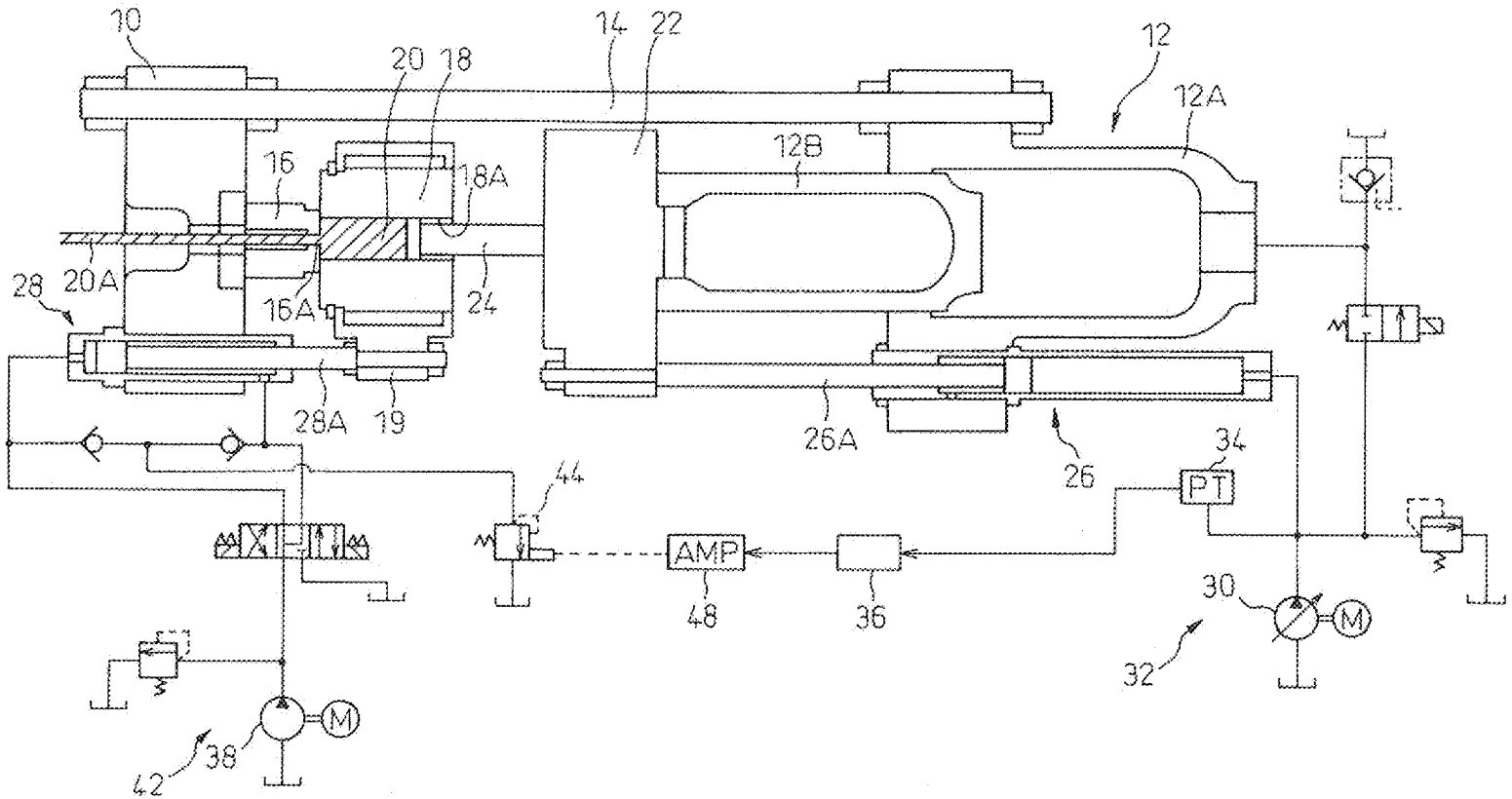
FIG. 1 is a section view of an extrusion press according to an embodiment of the present invention.

FIG. 1 is a section view of an extrusion press according to an embodiment. As shown schematically, in the extrusion press, an end platen 10 and a main cylinder device 12 are arranged in opposition to each other and both are linked by a plurality of tie rods 14. On the inner surface of the end platen 10, a container 18 is arranged with a die 16 in which an extrusion hole is formed being sandwiched in between, and a billet 20 is loaded in the container 18 and a product with a section in accordance with a die hole 16A is extruded and molded by extruding under pressure the billet 20 toward the die 16.

The main cylinder device 12, that generates an extrusion force incorporates a main ram 12B in a main cylinder 12A and the main ram 12B can be moved under pressure toward the container 18. To the front end part of the main ram 12B, an extrusion stem 24 is attached in a state of projecting toward the container 18 via a crosshead 22 so as to be arranged concentrically with a billet load hole 18A of the container 18. Because of this, when the main cylinder device 12 is driven to advance the crosshead 22, the extrusion stem 24 is inserted into the billet load hole 18A of the container 18, and therefore, pressure is applied to the rear end surface of the loaded billet 20, and thus a product 20A is extruded.

To the main cylinder 12A, a side cylinder device 26 is attached in parallel with the extrusion axial center and its cylinder rod 26A is linked to the crosshead 22. Due to this, the configuration is such that the extrusion stem 24 is initially moved to the position close to the container 18 as a preparation process of the extrusion process and the operation of extrusion under pressure is performed using both the main cylinder device 12 and the side cylinder device 26.

To the end platen 10, a container shift cylinder device 28, as a moving means capable of freely moving the container 18 back and forth in the direction of the extrusion axis line, is attached, and its cylinder rod 28A is linked to a container holder 19. Due to this, the configuration is such that a sealed state is brought about as the preparation process of extrusion by causing the end surface of the die 16 to come into contact with the end surface of the container 18 and in the completion process, the end surface of the die 16 is separated from the end surface of the container 18 and thus a gap through which the remaining material of the billet 20 is discharged is secured.

The configuration of a drive hydraulic circuit of the main cylinder device 12 and a drive hydraulic circuit of the container shift cylinder device 28 is explained with reference to FIG. 1.

First, a hydraulic circuit 32 that drives the main cylinder device 12 comprises a hydraulic pump 30 of variable displacement type and the hydraulic pressure discharged therefrom is supplied to the main cylinder device 12 and the side cylinder device 26 via a hydraulic passage. To the hydraulic passage, a pressure sensor 34 that detects a hydraulic pressure is attached and thereby a detected hydraulic pressure is output to a controller 36.

A drive circuit 42 of the container shift cylinder device 28 is provided with a hydraulic pump 38 that supplies pressurized hydraulic oil to the container shift cylinder device 28. When pressurized hydraulic oil is supplied from the pump 38 to the rod side of the cylinder via the hydraulic passage, the cylinder rod 28A is pulled in and driven and thus a container sealing force is caused to occur. It is designed so that when pressurized hydraulic oil is supplied to the head side of the cylinder, a hydraulic pressure that drives the cylinder rod 28A to project is caused to occur. The hydraulic circuit 42 is provided with a proportional electromagnetic relief valve 44 that adjusts the hydraulic pressure to be supplied to the container shift cylinder device 28 and the pressure control is performed via an amplifier 48 in accordance with the set instruction value by a control signal from the controller 36, which is output in accordance with the hydraulic pressure detected by the pressure sensor 34 of the drive hydraulic circuit 32 of the main cylinder device 12.

Figure 2:
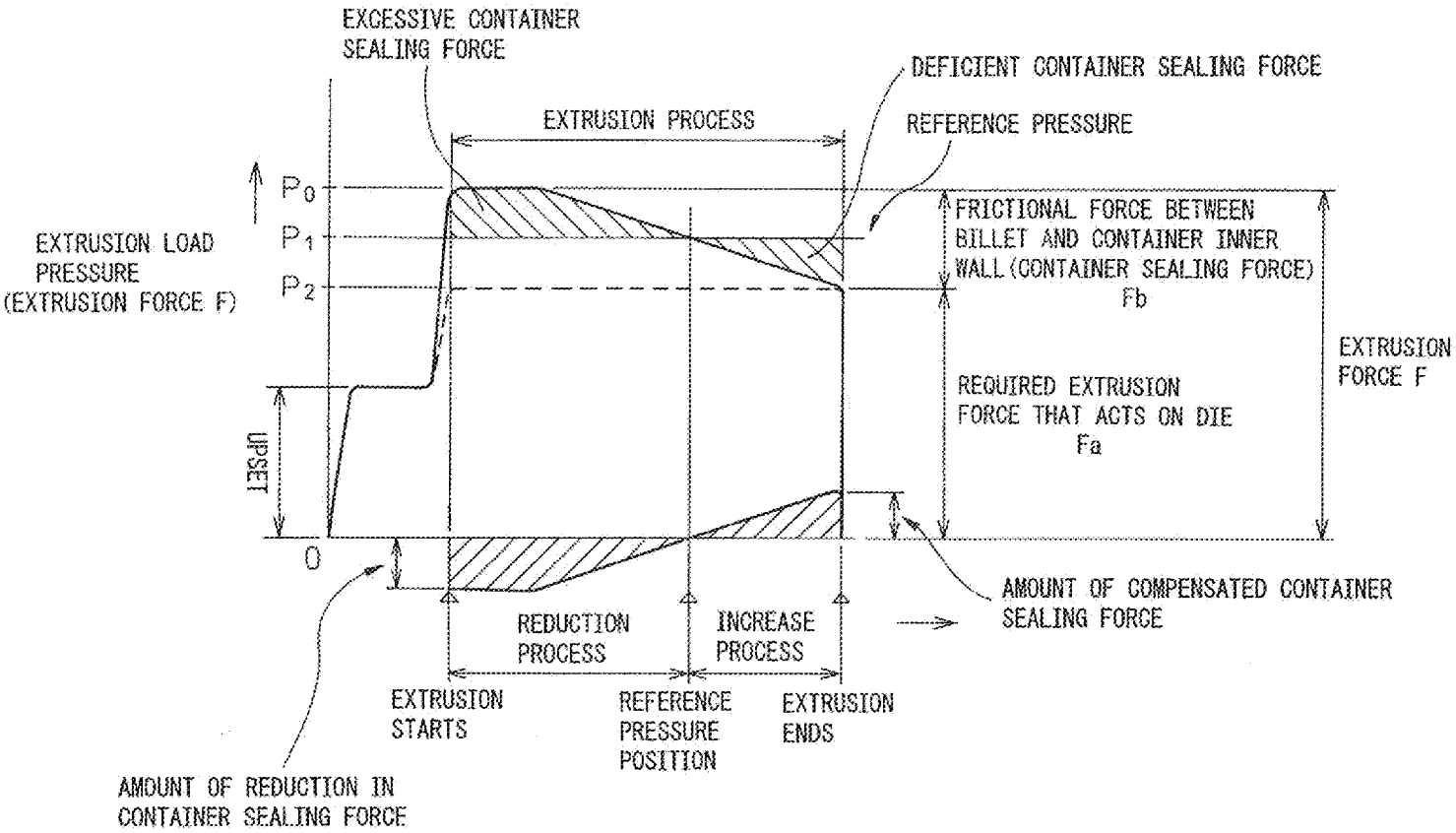
FIG. 2 is a characteristic chart of an extrusion force of the present invention.

As described above, during the extrusion process, extrusion is performed by the main cylinder device 12 and the side cylinder device 26, and an extrusion force (F) at the time of extrusion is expressed by the sum of a required extrusion force (Fa) that acts on the die 16 and a frictional force (Fb) between the billet 20 and the inner wall of the container 18. As shown in FIG. 2, the extrusion force (F) and the frictional force (Fb) between the billet 20 and the inner wall of the container 18 become maximum when extrusion starts and as the extrusion process advances and the length of the billet 20 reduces, the frictional force (Fb) is reduced, and therefore, the extrusion force (F) is reduced as a result.

The required extrusion force (Fa) that acts on the die 16 is substantially uniform and if the temperature condition of the billet is the same, it rarely happens that the required extrusion force varies.

As shown in FIG. 2, a reference pressure P1 capable of maintaining a predetermined container sealing force also in the final step of the extrusion process and controlling constant the container sealing force is set lower than a maximum load pressure P0 and higher than a required load pressure P2 that acts on the die. In this case, in the first half of the extrusion process in which the extrusion load pressure that changes from P0 to P2 is in a range higher than the reference pressure P1, the container sealing force acts excessively on the die and in the second half of the extrusion process in which the extrusion load force is in a range lower than the reference pressure P1, the container sealing force that acts on the die is deficient.

If, therefore, pressurized hydraulic oil based on the mathematically processed deviation is supplied to the head side of the container shift cylinder device 28 and caused to act so that the container 18 is pressed back from the die to reduce the container sealing force, it is possible to keep constant the container sealing force, in the range where the container sealing force acts excessively on the die and the load pressure is higher than the reference pressure P1.

On the other hand, in the range where the container sealing force acts deficiently on the die and the load pressure is lower than the reference pressure P1, if the pressurized hydraulic oil based on the mathematically processed deviation is supplied to the rod side of the container shift cylinder device 28 and caused to act so that the container 18 is pressed under pressure against the die to increase the container sealing force, it is possible to keep constant the container sealing force.

As described above, the controller 36 controls so that the container shift cylinder device 28, which is a moving means of the container, is caused to generate a correction force, and thus it is possible to correct and keep constant the container sealing force, and therefore, to keep constant the amount of displacement and deflection of the die.

The controller 36 inputs a detection signal detected by the pressure sensor 34 and stores the reference pressure P1, which serves as a value for comparison with the detected pressures, in its built-in memory. The configuration is such that the detected pressures are input successively in the extrusion process and the detected pressure that is input and the reference pressure P1 are compared and mathematically processed.

Then, a difference in pressure (δP) between them is calculated and when the difference in pressure is higher than the reference pressure P1, it means that the container sealing force acts excessively, and therefore, a pressure value Pc1 required to generate a correction force in accordance with the amount of excess and to be supplied to the head side of the container shift cylinder device 28 is calculated. The pressure value Pc1 can be calculated by multiplying the total section area of the main cylinder device 12 and the side cylinder device 26 by the detected difference in pressure (δP) and dividing the product by the section area of the container shift cylinder device 28. Then, voltage conversion processing corresponding to the calculated pressure value Pc1 is performed and its result is output to the amplifier 48 as an output signal, and thus the proportional electromagnetic relief valve 44 is controlled.

Due to this, it is possible to correct and keep constant the excessively acting container sealing force.

On the other hand, when the detected difference in pressure (δP) is lower than the reference pressure P1, it means that the container sealing force is deficient, and therefore, a pressure value Pc2 required to generate a correction force in accordance with the amount of deficiency and to be supplied to the rod side of the container shift cylinder device 28 is calculated. The pressure value Pc2 can be calculated by multiplying the total section area of the main cylinder device 12 and the side cylinder device 26 by the detected difference in pressure (δP) and dividing the product by the section area on the rod side of the container shift cylinder device 28. Then, voltage conversion processing corresponding to the calculated pressure value Pc2 is performed and its result is output to the amplifier 48 as an output signal, and thus the proportional electromagnetic relief valve 44 is controlled.

Due to this, it is possible to correct and keep constant the deficient container sealing force.

Figure 3:
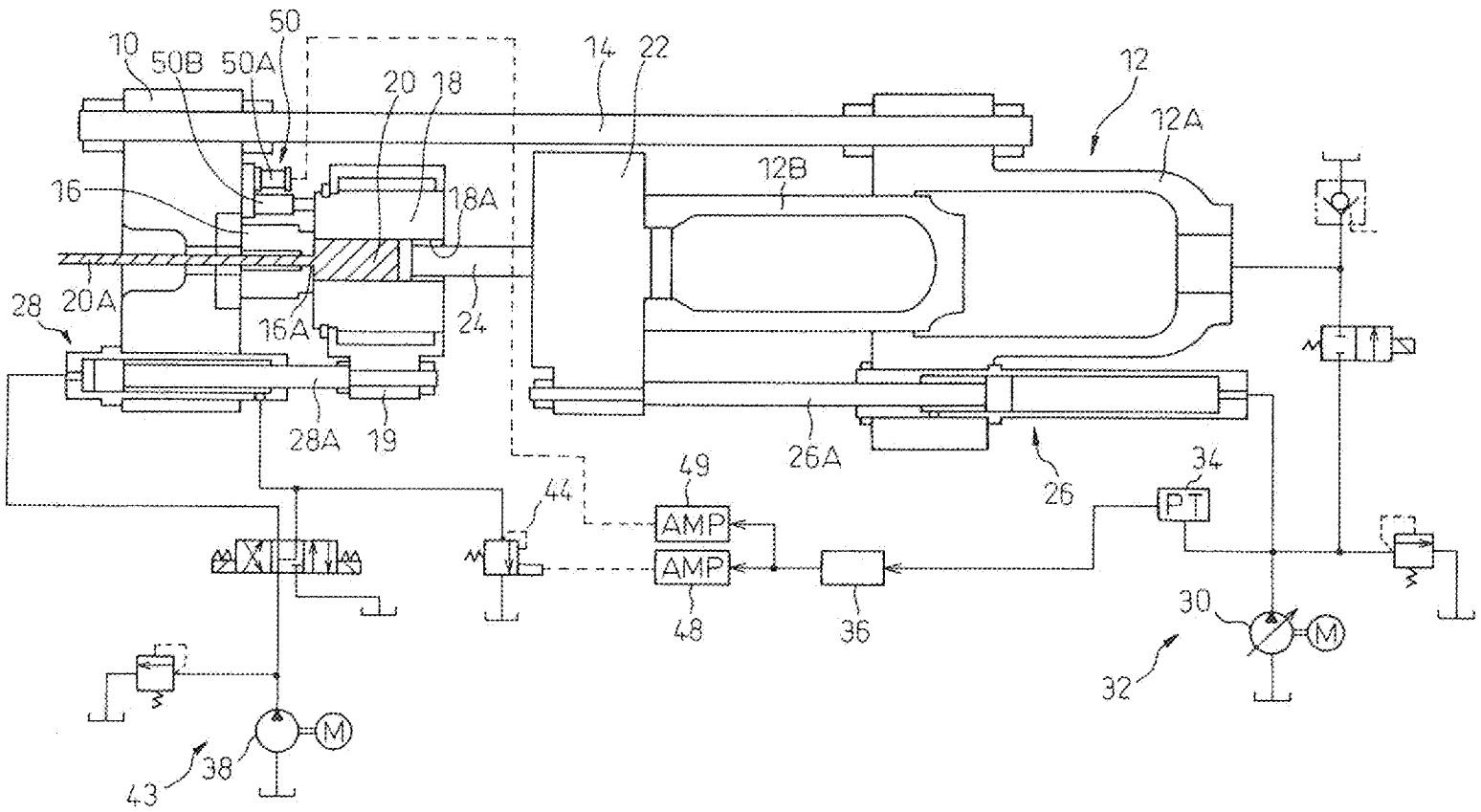
FIG. 3 is a section view of an extrusion press according to another embodiment of the present invention.

FIG. 3 is a section view of an extrusion press according to another embodiment. As shown schematically, the basic configuration is substantially the same as the extrusion press shown in FIG. 1 described above and only configurational parts that are different are explained and other configurational parts should be referred to the explanation of FIG. 1 described above. The same symbols are given to the same parts as those in FIG. 1.

In FIG. 3, between the end platen 10 and the container 18, a plurality of container drive means 50 arranged so as to surround the die 16 are provided. The drive means 50 is attached fixedly to the end platen 10 and is basically configured to include an electric servomotor 50A, which is a drive source, and a ball screw converter SOB that converts the rotational motion of the output shaft of the electric servomotor 50A into a linear motion, including a screw shaft and a ball nut. The drive means 50 is attached so that the direction in which the screw shaft extends is in parallel with the extrusion axis line of the extrusion press and is designed so that the tip end of the screw shaft can come into contact with the end surface of the container 18 and a correction force can be generated by pressing under pressure the container 18 using the drive of the electric servomotor 50A.

In FIG. 3, the configuration is such that the container drive means 50 is attached to the end platen 10, the container 18 is pressed back by the screw shaft, and thus the container sealing force is reduced, however, a configuration may be accepted, in which the container drive means 50 is provided on the container side and the end platen 10 is pressed under pressure, and thus the container 18 is pressed under pressure.

The configuration of the drive hydraulic circuit of the main cylinder device 12 and the drive hydraulic circuit of the container shift cylinder device 28 is explained with reference to FIG. 3.

First, the hydraulic circuit 32 that drives the main cylinder device 12 comprises the hydraulic pump 30 of variable displacement type and the hydraulic pressure discharged therefrom is supplied to the main cylinder device 12 and the side cylinder device 26 via a hydraulic passage. To the hydraulic passage, the pressure sensor 34 that detects a hydraulic pressure is attached and the detected hydraulic pressure is output to the controller 36.

A drive circuit 43 of the container shift cylinder device 28 comprises the hydraulic pump 38 that supplies pressurized hydraulic oil to the container shift cylinder device 28. It is designed so that when pressurized hydraulic oil is supplied from the pump 38 to the rod side of the cylinder via the hydraulic passage, the cylinder rod 28A is pulled in and driven and thus a container sealing force is generated. When pressurized hydraulic oil is supplied to the head side of the cylinder, a hydraulic pressure is generated, which causes to project and drive the cylinder rod 28A. The hydraulic circuit 43 is provided with the proportional electromagnetic relief valve 44 that adjusts the hydraulic pressure to be supplied to the rod side of the container shift cylinder device 28, and pressure is controlled via the amplifier 48 in accordance with the set instruction value by a control signal from the controller 36, which is output in accordance with the hydraulic pressure detected by the pressure sensor 34 in the drive hydraulic circuit of the main cylinder device 12.

Then, as shown in FIG. 2, the container sealing force reference pressure P1 capable of maintaining a predetermined container sealing force also in the final step of the extrusion process and controlling constant the container sealing force is set lower than the maximum load pressure P0 and higher than the required extrusion load pressure P2 that acts on the die. In this case, in the first half of the extrusion process in which the extrusion load pressure that changes from P0 to P2 is in a range higher than the reference pressure P1, the container sealing force acts excessively and in the second half of the extrusion process in which the extrusion load force is in a range lower than the reference pressure P1, the container sealing force is deficient.

If, therefore, a correction value based on the mathematically processed deviation is output to the electric servomotor 50A of the drive means 50 and caused to act so that the container 18 is pressed back from the die to reduce the container sealing force, it is possible to correct and keep constant the container sealing force, in the range where the container sealing force acts excessively and the load pressure is higher than the reference pressure P1.

On the other hand, in the range where the container sealing force acts deficiently and the load pressure is lower than the reference pressure P1, if the pressurized hydraulic oil based on the mathematically processed deviation is supplied to the rod side of the container shift cylinder device 28 and caused to act so that the container 18 is pressed under pressure against the die to increase the container sealing force, it is possible to correct and keep constant the container sealing force.

As described above, the controller 36 controls so that the container shift cylinder device 28, which is a moving means of the container, generates a correction force, and thus it is possible to keep constant the container sealing force, and therefore, to keep constant the amount of displacement and deflection of the die.

The controller 36 inputs a detection signal by the pressure sensor 34 and stores the reference pressure P1, which serves as a value for comparison with a detected pressure, in a built-in memory. The configuration is such that the detected pressures are input successively in the extrusion process and the input detected pressure and the reference pressure P1 are compared and mathematically processed.

Then, the difference in pressure (δP) between them is calculated and when the difference in pressure is higher than the reference pressure P1, it means that the container sealing force acts excessively, and therefore, a torque value required to generate a correction force in accordance with the amount of excess and to be output to the electric servomotor 50A of the drive device 50 is calculated. The torque value can be obtained by mathematically processing the load calculated by multiplying the total section area of the main cylinder device 12 and the side cylinder device 26 by the detected difference in pressure (δP) and dividing the product by the section area of the container shift cylinder device 28. Then, conversion processing corresponding to the mathematically processed and calculated torque value is performed and its result is output to the amplifier 49 as an output signal, and thus the electric servomotor 50A is controlled.

Due to this, it is possible to correct and keep constant the excessively acting container sealing force.

On the other hand, when the detected difference in pressure (δP) is lower than the reference pressure P1, it means that the container sealing force is deficient, and therefore, the pressure value Pc2 required to generate a correction force in accordance with the amount of deficiency and to be supplied to the rod side of the container shift cylinder device 28 is calculated. The pressure value Pc2 can be calculated by multiplying the total section area of the main cylinder device 12 and the side cylinder device 26 by the detected difference in pressure (δP) and dividing the product by the section area on the rod side of the container shift cylinder device 28. Then, voltage conversion processing corresponding to the calculated pressure value Pc2 is performed and its result is output to the amplifier 48 as an output signal, and thus the proportional electromagnetic relief valve 44 is controlled.

Due to this, it is possible to correct and keep constant the deficient container sealing force.

Figure 4:
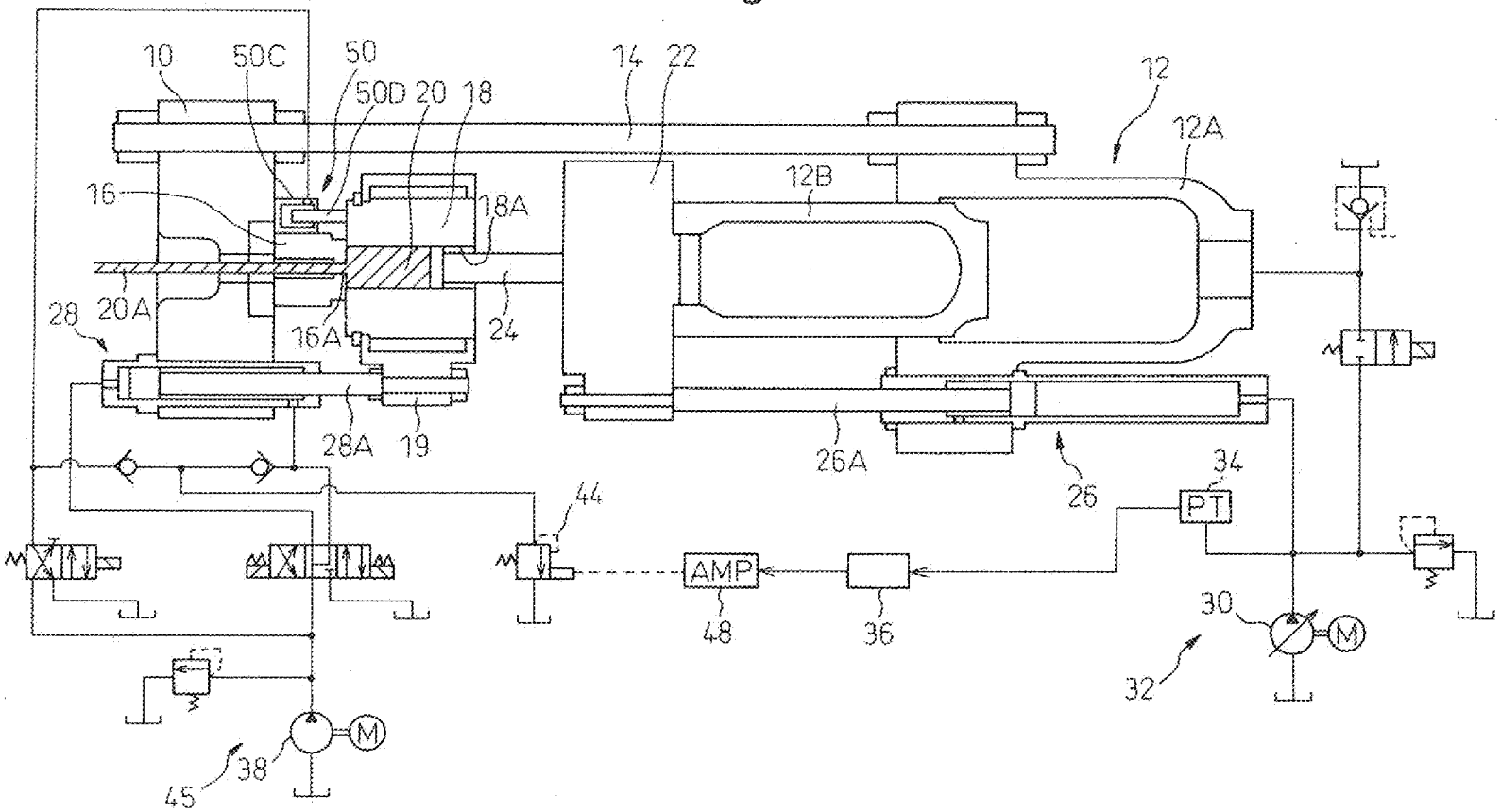
FIG. 4 is a section view of an extrusion press according to another embodiment.

FIG. 4 is a section view of an extrusion press showing another aspect, in which the drive means 50 of the container 18 is used as a hydraulic cylinder in the aspect in FIG. 3. In FIG. 4, between the end platen 10 and the container 18, a hydraulic cylinder 50C is provided as the plurality of the drive means 50 of the container 18 arranged so as to surround the die 16. The hydraulic cylinder 50C comprises a drive hydraulic circuit 45 and is attached so that the direction in which a ram SOD extends is in parallel with the extrusion axis line of the extrusion press, and the tip end of the ram 50D can come into contact with the end surface of the container 18 and the container 18 is pressed under pressure by the drive of the hydraulic cylinder 50C to generate a correction force.

This differs from that in FIG. 3 in the following points. That is, when the container sealing force is reduced, the controller 36 inputs a detection signal by the pressure sensor 34 and stores the reference pressure P1, which is a value used in comparison with a detected pressure, in the built-in memory. The configuration is such that the detected pressures are input successively in the extrusion process and the detected pressure that is input and the reference pressure P1 are compared and mathematically processed.

Then, the difference in pressure (δP) between them is calculated and when the difference in pressure is higher than the reference pressure P1, it means that the container sealing force acts excessively, and therefore, a pressure value Pc3 required to generate a correction force in accordance with the amount of excess and to be supplied to the hydraulic cylinder 50C is calculated. The pressure value Pc3 can be calculated by multiplying the total section area of the main cylinder device 12 and the side cylinder device 26 by the detected difference in pressure (δP) and dividing the product by the section area of the hydraulic cylinder 50C. Then, voltage conversion processing corresponding to the calculated pressure value Pc3 is performed and its result is output to the amplifier 48 as an output signal, and thus the proportional electromagnetic relief valve 44 is controlled.

Figure 5:
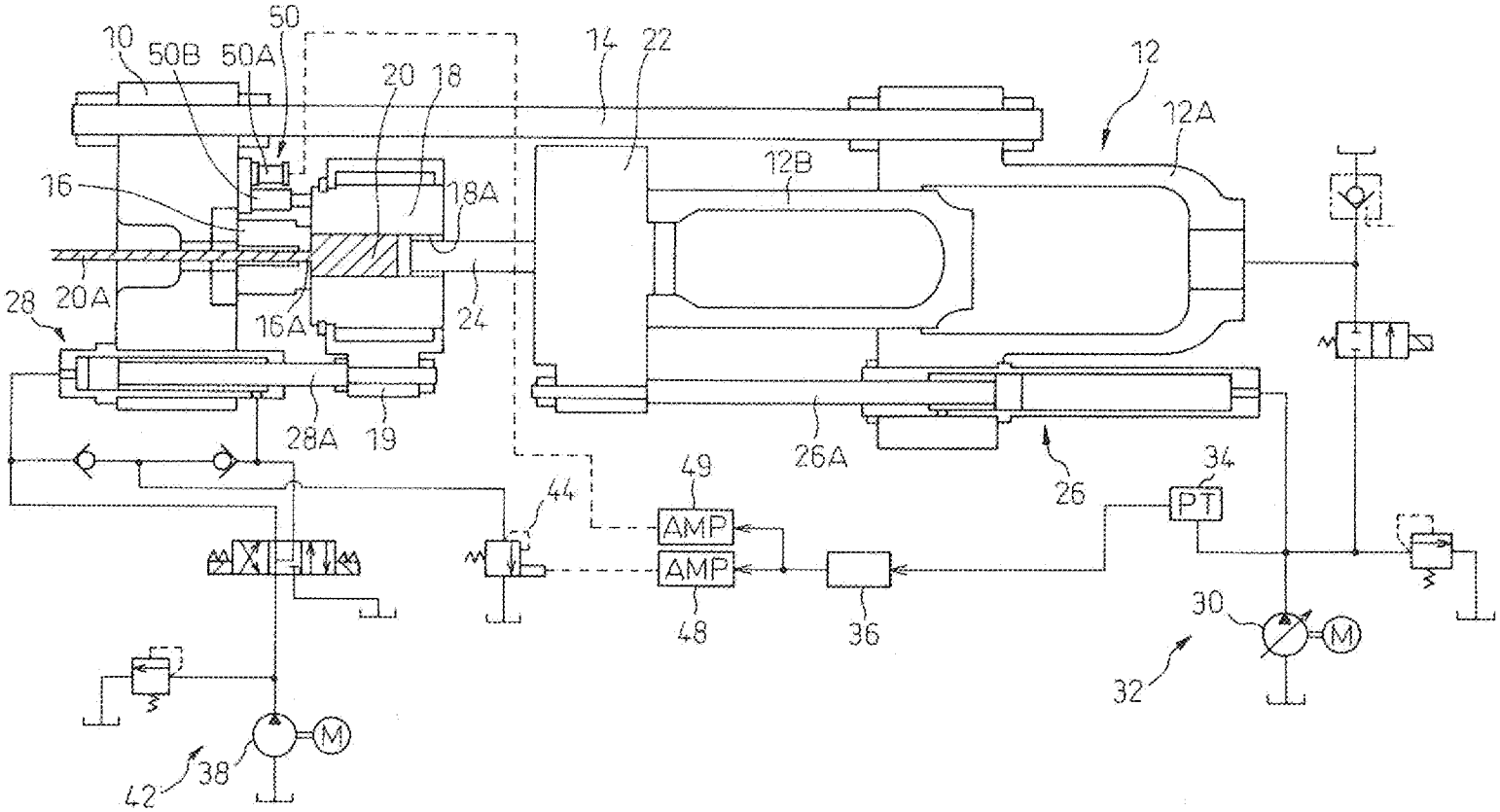
FIG. 5 is a section view of an extrusion press according to still another embodiment.

FIG. 5 is a section view of an extrusion press according to still another embodiment, and its configuration adopts both aspects in FIG. 1 and FIG. 2. A configuration is shown, in which when the container sealing force is reduced, an output is sent to the moving means and the drive means of the container, and the amount of control to be output to the proportional electromagnetic relief valve 44 that controls a hydraulic pressure to be supplied to the head side of the container shift cylinder device 28 and the electric servomotor 50A is output to the amplifiers 48, 49, respectively, by the controller 36 in accordance with a reference determined in advance, and thus the container sealing force is corrected. The correction to increase the container sealing force makes use of the means to apply a predetermined pressure to the rod 12A side of the container shift cylinder device 28 described above.

As explained above, the hydraulic pressure of the main cylinder device 12 during the extrusion process is detected and compared with the reference pressure P1 set in advance and then mathematically processed, and correction is made so as to reduce the container sealing force when the deviation is plus with respect to the reference value, or to increase the container sealing force when the deviation is minus with respect to the reference value, and therefore, it is possible to keep constant the container sealing force in the extrusion process. As a result, it is possible to keep constant the amount of displacement and deflection of the die, and therefore, to make uniform the thickness and shape of the extruded product 20A in the longitudinal direction, and to considerably improve the product yields.

In addition, it is possible to make constant the pressing force of the die without increasing the load pressure of the main cylinder device when correcting and keeping constant the container sealing force, and therefore, energy efficiency can be improved and the amount of energy consumption can be reduced.

Further, there is an excellent effect that the container sealing force can be kept constant during the extrusion process and can be kept to a desired container sealing force, and the occurrence of burr caused by the bursting phenomenon from the sealing surface can be effectively prevented.

The amount of deformation and deflection of the end platen that is added when the correction force is caused to act on the container sealing force becomes small because the load is spread to the end platen not from the die sealing end surface but via the container shift cylinder device and the moment (force moment) that acts on the end platen is improved to be smaller, and therefore, the influence on the die works in a better manner.

Figure 6:
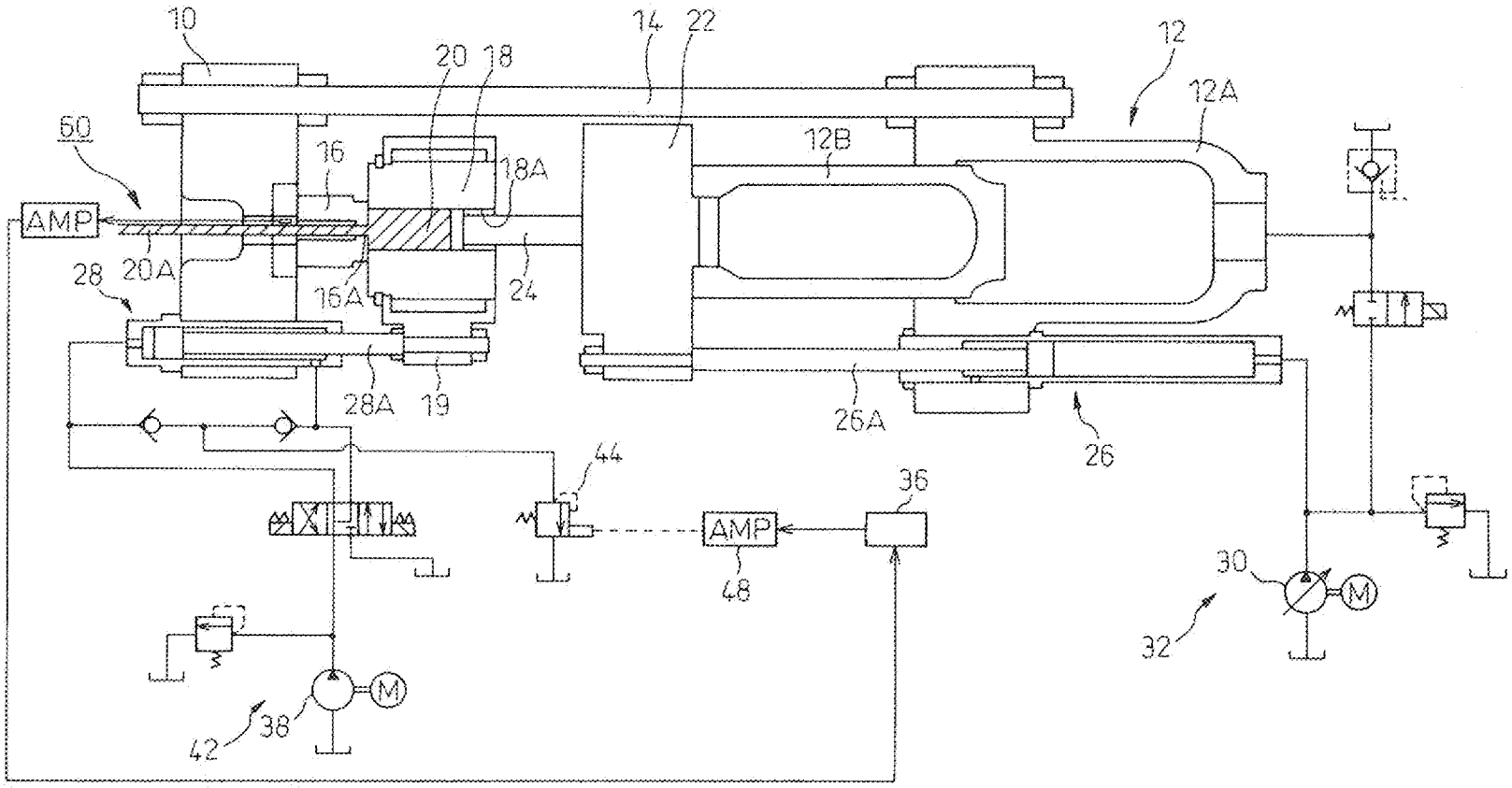
FIG. 6 is a section view of an extrusion press according to another embodiment of the present invention.

FIG. 6 is a section view of an extrusion press according to an embodiment. As shown in FIG. 6, in the extrusion press, the end platen 10 and the main cylinder device 12 are arranged in opposition to each other and both are linked by a plurality of tie rods 14. On the inner surface of the end platen 10, the container 18 is arranged with the die unit 16 in which an extrusion hole is formed being sandwiched between the end platen 10 and the container 18, and the billet 20 is loaded in the container 18 and a product with a section in accordance with the die hole 16A is extruded and molded by extruding under pressure the billet 20 toward the die unit 16.

The main cylinder device 12 that generates an extrusion force incorporates the main ram 12B in the main cylinder 12A and the main ram 12B can be moved under pressure toward the container 18. To the front end part of the main ram 18B, the extrusion stem 24 is attached in a state of projecting toward the container 18 via the crosshead 22 so as to be arranged concentrically with the billet load hole 18A of the container 18. Because of this, when the main cylinder device 12 is driven to advance the crosshead 22, the extrusion stem 24 is inserted into the billet load hole 18A of the container 18, and therefore, pressure is applied to the rear end surface of the loaded billet 20, and thus the product 20A is extruded.

To the main cylinder 12A, the side cylinder device 26 is attached in parallel with the extrusion axial center and its cylinder rod 26A is linked to the crosshead 22. Due to this, the configuration is such that the extrusion stem 24 is initially moved to the position close to the container 18 as a preparation process of the extrusion process and the operation of extrusion under pressure is performed using both the main cylinder device 12 and the side cylinder device 26.

To the end platen 10, the container shift cylinder device 28, as a moving means capable of freely moving the container 18 back and forth in the direction of the extrusion axis line, is attached, and its cylinder rod 28A is linked to the container holder 19. Due to this, the configuration is such that a sealed state is brought about as the preparation process of extrusion by causing the end surface of the die unit 16 to come into contact with the end surface of the container 18 and in the completion process of extrusion, the end surface of the die unit 16 is separated from the end surface of the container 18 and thus a gap through which the remaining material of the billet 20 is discharged is secured.

Then, the configuration is such that a die deflection detection device 60 is provided on the end surface on the product discharge side of the die unit 16 arranged on the inner surface of the end platen 10, and the amount of deflection of the die that deforms by the extrusion force during the extrusion process is detected.

The configuration of a drive hydraulic circuit of the main cylinder device 12 and a drive hydraulic circuit of the container shift cylinder device 28 is explained with reference to FIG. 6.

First, the hydraulic circuit 32 that drives the main cylinder device 12 comprises the hydraulic pump 30 of variable displacement type, and the hydraulic pressure discharged therefrom is supplied to the main cylinder device 12 and the side cylinder device 26 via a hydraulic passage.

The drive circuit 42 of the container shift cylinder device 28 is provided with the hydraulic pump 38 that supplies pressurized hydraulic oil to the container shift cylinder device 28. When pressurized hydraulic oil is supplied from the pump 38 to the rod side of the container shift cylinder via the hydraulic passage, the cylinder rod 28A is pulled in and driven and thus a container sealing force is caused to occur. It is designed so that when pressurized hydraulic oil is supplied to the head side of the container shift cylinder, the cylinder rod 28A is caused to project and the container 18 is separated from the die unit 16. The hydraulic circuit 42 is provided with the proportional electromagnetic relief valve 44 that adjusts the hydraulic pressure to be supplied to the container shift cylinder device 28 and the pressure control is performed via the amplifier 48 in accordance with the set instruction value based on a control signal that is output from the controller 36 in accordance with the amount of deflection of the die detected by a die deflection sensor 62 of the die deflection detection device 60.

Then, the control means of the container moving means comprises the controller 36 and the amplifier 48.

Figure 7:
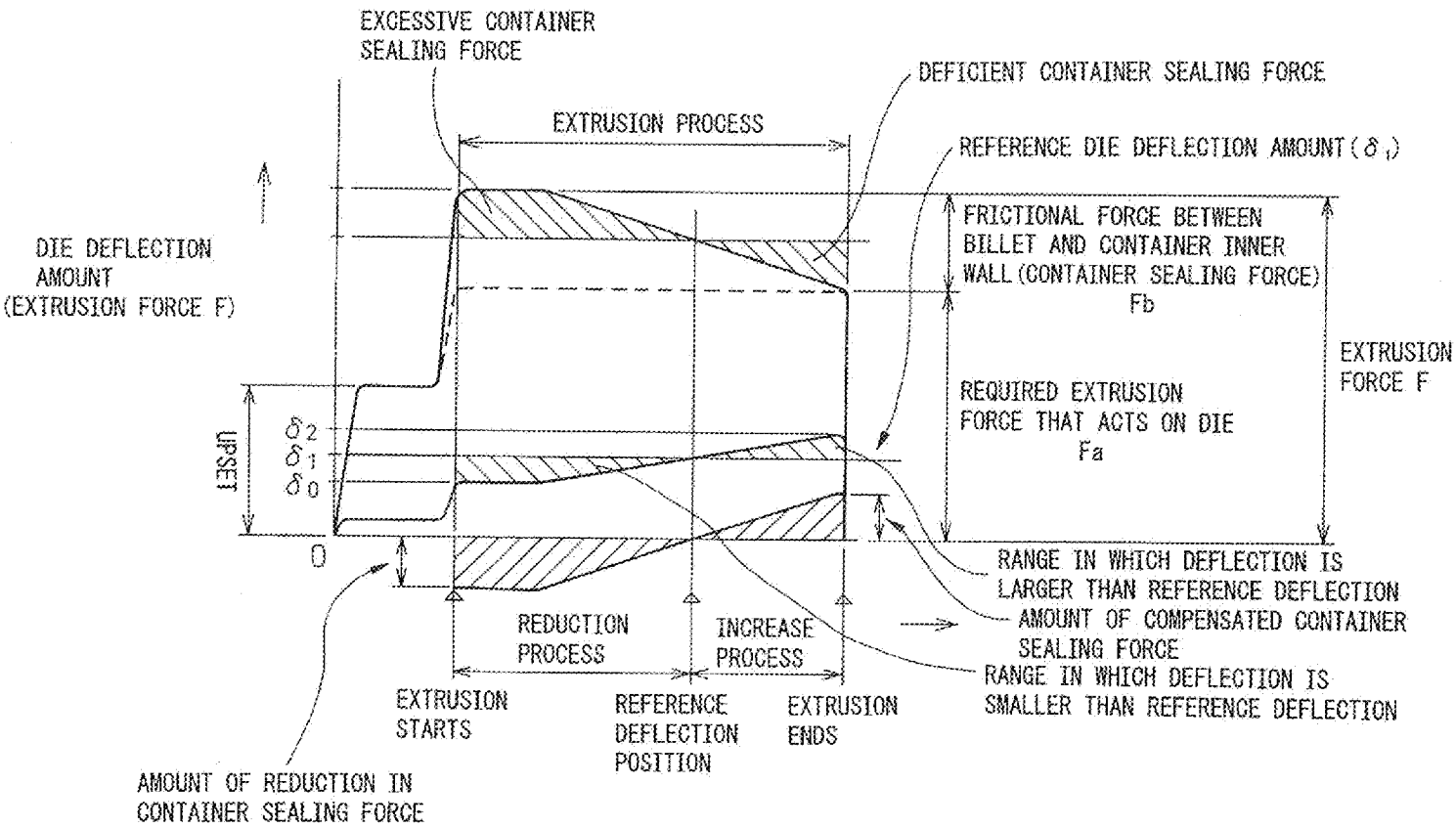
FIG. 7 is a characteristic chart of an extrusion force of the present invention.

As described above, the extrusion process is performed by the main cylinder device 12 and the side cylinder device 26. Then, the extrusion force (F) during the extrusion process is expressed by the sum of the required extrusion force (Fa) that acts on the die unit 16 and the frictional force (Fb) between the billet 20 and the inner wall of the container 18. As shown in FIG. 7, the extrusion force (F) and the frictional force (Fb) between the billet 20 and the inner wall of the container 18 become maximum when extrusion starts and because of the reduction in the frictional force (Fb) accompanying the reduction in length of the billet 20 as the extrusion process advances, the extrusion force (F) is reduced.

The required extrusion force (Fa) that acts on the die unit 16 is substantially uniform and if the temperature condition of the billet 20 is the same, it rarely happens that the required extrusion force varies.

As shown in FIG. 7, a deflection amount δ1 of the die capable of ensuring a predetermined container sealing force also in the final step of the extrusion process and serving as a reference to keep constant the container sealing force is set smaller than a maximum load deflection amount δ2 and larger than a required load deflection amount δ0 that acts on the die. In this case, in the first half of the extrusion process in which the deflection amount that changes from δ0 to δ2 is in a range smaller than the reference deflection amount δ1, the container sealing force acts excessively on the die and in the second half of the extrusion process in which the deflection amount is in a range larger than the reference deflection amount δ1, the container sealing force that acts on the die is deficient.

If, therefore, a hydraulic pressure calculated by mathematically processing the deviation of the defection amount is supplied to the head side of the container shift cylinder device 28 and thereby the container 18 is moved in the direction in which the container 18 is pressed back from the die unit 16 to reduce the container sealing force, it is possible to correct and keep constant the container sealing force, in the first half of the extrusion process in which the container sealing force acts excessively on the die and the deflection amount of the die is smaller than the reference value.

On the other hand, in the second half of the extrusion process in which the container sealing force acts deficiently on the die and the deflection amount is larger than the reference value, if a hydraulic pressure calculated by mathematically processing the deviation of the deflection amount is supplied to the rod side of the container shift cylinder device 28 and thereby the container 18 is moved in the direction in which the container 18 is pressed under pressure from the die unit 16 to increase the container sealing force, it is possible to correct and keep constant the container sealing force.

As described above, the controller 36 controls the hydraulic pressure to cause the container shift cylinder device 28, which is a moving means of the container 18, to generate a correction force, and thus it is possible to keep constant the container sealing force, and therefore, to maintain constant the deflection amount of the die.

The controller 36 is input with a detection signal from the die deflection sensor 62 of the die deflection detection device 60 via an amplifier and stores the reference deflection amount δ1, which serves as a value for comparison with a detected deflection amount, in its built-in memory.

Then, the configuration is such that the detected deflection amounts are input successively in the extrusion process and the input deflection amount and the reference deflection amount δ1 are compared and mathematically processed, and a deviation between them is mathematically processed and when the deviation is minus, that is, the deflection amount is smaller than the reference deflection amount δ1, it means that the container sealing force acts excessively, and therefore, the pressure value Pc1 of the hydraulic oil required to generate a correction force in accordance with the amount of excess and to be supplied to the head side of the container shift cylinder device 28 is calculated.

The pressure value Pc1 can be obtained by storing in advance the relationship between the extrusion force and the die deflection amount in the controller 36, calculating the extrusion force from the mathematically processed deviation, and at the same time, dividing the calculated extrusion force by the section area of the container shift cylinder device 28. Next, voltage conversion processing corresponding to the calculated pressure value Pc1 is performed and its result is output to the amplifier 48, and thus the proportional electromagnetic relief valve 44 is controlled. Due to this, it is possible to correct and make constant the container sealing force that acts excessively on the die.

On the other hand, when the mathematically processed deviation is plus, i.e., the deflection amount is larger than the reference deflection amount δ1, it means that the container sealing force is deficient, and therefore, the hydraulic pressure value Pc2 required to generate a correction force in accordance with the amount of deficiency and to be supplied to the rod side of the container shift cylinder device 28 is calculated.

The pressure value Pc2 can be obtained by calculating using the relationship between the stored extrusion force and the die deflection amount and dividing the calculated extrusion force by the section area on the rod side of the container shift cylinder device 28. Next, voltage conversion processing corresponding to the calculated pressure value Pc2 is performed and its result is output to the amplifier 48, and thus the proportional electromagnetic relief valve 44 is controlled. Due to this, it is possible to correct and make constant the deficient container sealing force that acts on the die.

Figure 8:
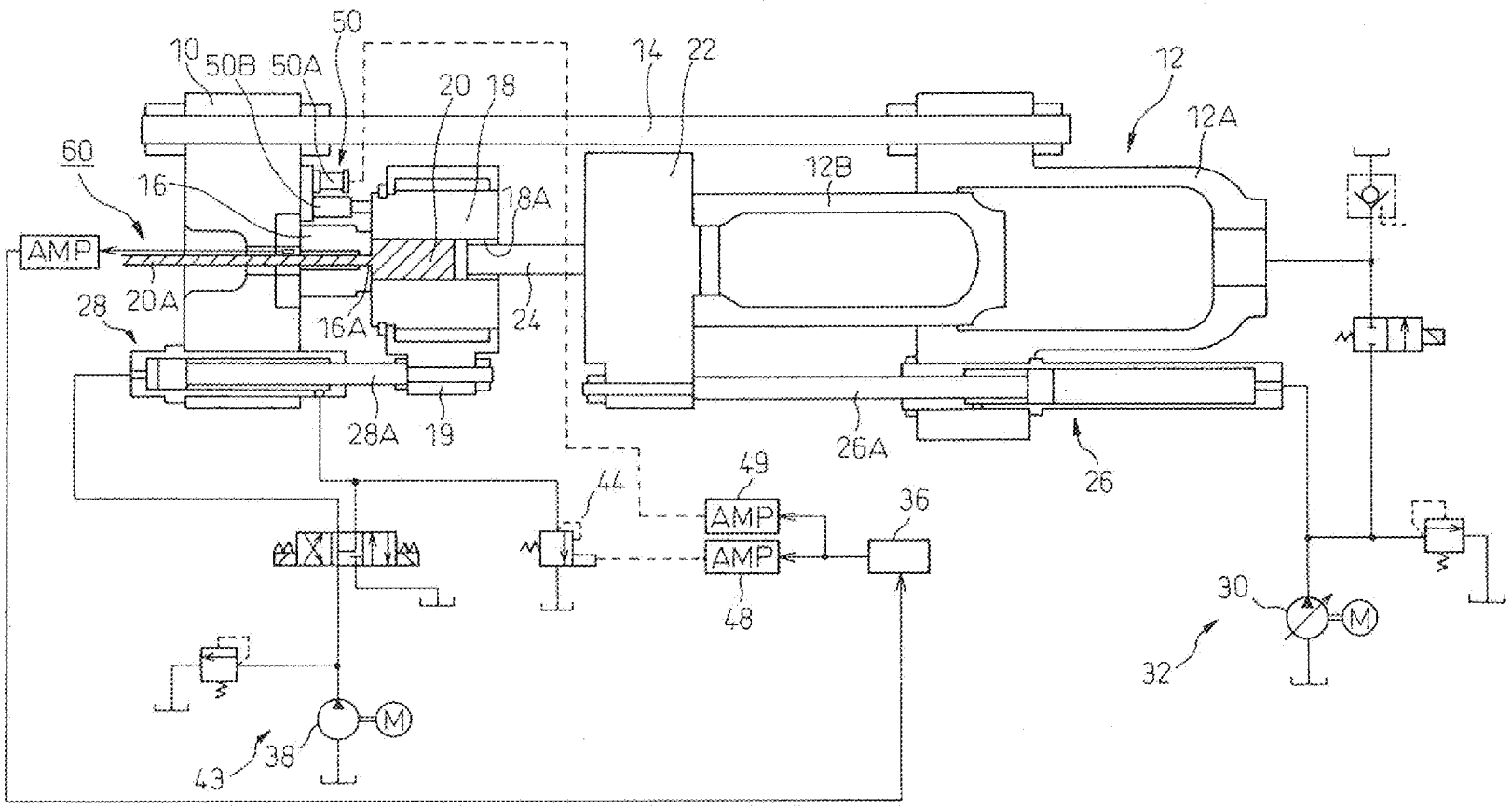
FIG. 8 is a section view of an extrusion press according to another embodiment of the present invention.

FIG. 8 is a section view of an extrusion press according to another embodiment. As shown schematically, the basic configuration is substantially the same as the extrusion press in FIG. 6 described above, and only different constitutional parts are explained and other configurational parts should be referred to the explanation of FIG. 6 described above. The same symbols are given to the same parts as those in FIG. 6.

In FIG. 8, between the end platen 10 and the container 18, a plurality of drive means 50 of the container 18 arranged so as to surround the die unit 16 are provided. The drive means 50 is attached fixedly to the end platen 10 and its basic configuration includes the electric servomotor 50A, which is a drive source, and the ball screw converter 50B that converts the rotational motion of the output shaft of the electric servomotor 50A into a linear motion, including a screw shaft and ball nut. The drive means 50 is attached so that the direction in which the screw shaft extends is parallel with the extrusion axis line of the extrusion press and is designed so that the tip end of the screw shaft can come into contact with the end surface of the container 18 and a correction force can be generated by pressing under pressure the container 18 using the drive of the electric servomotor 50A.

In FIG. 8, the configuration is such that the drive means 50 of the container 18 is attached to the end platen 10, the container 18 is pressed back by the screw shaft, and thus the container sealing force is reduced, however, a configuration may be accepted, in which the drive means 50 of the container 18 is provided on the container 18 side and the end platen 10 is pressed under pressure, and thus the container 18 is pressed back.

The configuration of the drive hydraulic circuit of the main cylinder device 12 and the drive hydraulic circuit of the container shift cylinder device 28 is explained with reference to FIG. 8.

First, the hydraulic circuit 32 that drives the main cylinder drive 12 comprises the hydraulic pump 30 of variable displacement type and the hydraulic pressure discharged therefrom is supplied to the main cylinder device 12 and the side cylinder device 26 via a hydraulic passage.

The drive circuit 43 of the container shift cylinder device 28 comprises the hydraulic pump 38 that supplies pressurized hydraulic oil to the container shift cylinder device 28. It is designed so that when pressurized hydraulic oil is supplied from the hydraulic pump 38 to the rod side of the container shift cylinder via a hydraulic passage, the cylinder rod 28A is pulled in and driven, and thus a container sealing force is generated. The hydraulic circuit 43 is provided with the proportional electromagnetic relief valve 44 that adjusts the hydraulic pressure to be supplied to the container shift cylinder rod side, and pressure control is performed via the amplifier 48 in accordance with the set instruction value by the control signal from the controller 36, which is output in accordance with the deflection amount of the die detected by the die deflection sensor provided in the die deflection detection device 60.

Then, the deflection amount δ1 of the die capable of securing a predetermined container sealing force also in the final step of the extrusion process and serving as a reference to keep constant the container sealing force is set smaller than the maximum load deflection amount δ2 and larger than the required load deflection amount δ0 that acts on the die. In this case, in the first half of the extrusion process in which the deflection amount that changes from P0 to P2 is in a range smaller than the reference deflection amount δ1, the container sealing force acts excessively on the die and in the second half of the extrusion process in which the deflection amount is larger than the reference deflection amount δ1, the container sealing force that acts on the die is deficient.

If, therefore, a correction value based on the mathematically processed deviation is output to the electric servomotor 50A of the drive means 50 and caused to act so that the container 18 is pressed back from the die unit 16 to reduce the container sealing force, it is possible to correct and keep constant the container sealing force in the first half of the extrusion process in which the container sealing force acts excessively on the die and the deflection amount of the die is smaller than the reference value.

On the other hand, in the second half of the extrusion process in which the container sealing force is deficient and the deflection amount that acts on the die is larger than the reference value, it is possible to correct and keep constant the container sealing force by supplying the hydraulic pressure mathematically processed and calculated from the deviation of the deflection amount to the rod side of the container shift cylinder device 28 and moving the container 18 from the die unit 16 in the direction of pressing under pressure to increase the container sealing force.

As described above, the container sealing force is kept constant, and therefore, the deflection amount of the die is kept constant by causing the container shift cylinder device 28, which is a moving means of the container 18, and the container drive device 50 to generate a correction force.

The controller 36 inputs a detection signal from the die deflection sensor 62 of the die deflection detection device 60 via an amplifier and stores the reference deflection amount δ1, which serves as a value for comparison with a detected deflection amount, in a built-in memory. Then, the configuration is such that the deflection amounts detected in the extrusion process are input successively and the input deflection amount and the reference deflection amount δ1 are compared and mathematically processed.

When the mathematically processed deviation is minus, i.e., when the deflection amount is smaller than the reference deflection amount δ1, it means that the container sealing force acts excessively, and therefore, a torque value required to generate a correction force in accordance with the amount of excess and to be output to the electric servomotor 50A of the container drive device 50 is calculated. The torque value is obtained by storing in advance the relationship between the extrusion force and the die deflection amount in the controller 36 and calculating the extrusion force from the mathematically processed deviation. Then, conversion processing corresponding to the mathematically processed torque value is performed and its result is output to the amplifier 49 as an output signal, and thus the electric servomotor 50A is controlled.

Due to this, it is possible to correct and keep constant the container sealing force that acts excessively on the die.

On the other hand, when the mathematically processed deviation is plus, i.e., when the deflection amount is larger than the reference deflection δ1, it means that the container sealing force is deficient, and therefore, the hydraulic pressure value Pc2 required to generate a correction force in accordance with the amount of deficiency and to be supplied to the rod side of the container shift cylinder device 28 is calculated.

The pressure value Pc2 is obtained by calculating the extrusion force using the stored relationship between the extrusion force and the die deflection amount and dividing the calculated extrusion force by the section area on the rod side of the container shift cylinder device 28. Next, voltage conversion processing corresponding to the calculated pressure value Pc2 is performed and its result is output to the amplifier 48, and thus the proportional electromagnetic relief valve 44 is controlled. Due to this, it is possible to correct and keep constant the deficient container sealing force that acts on the die.

Then, the control means of the container drive means 50 is configured by the controller 36 and the amplifier 49 described above.

Figure 9:
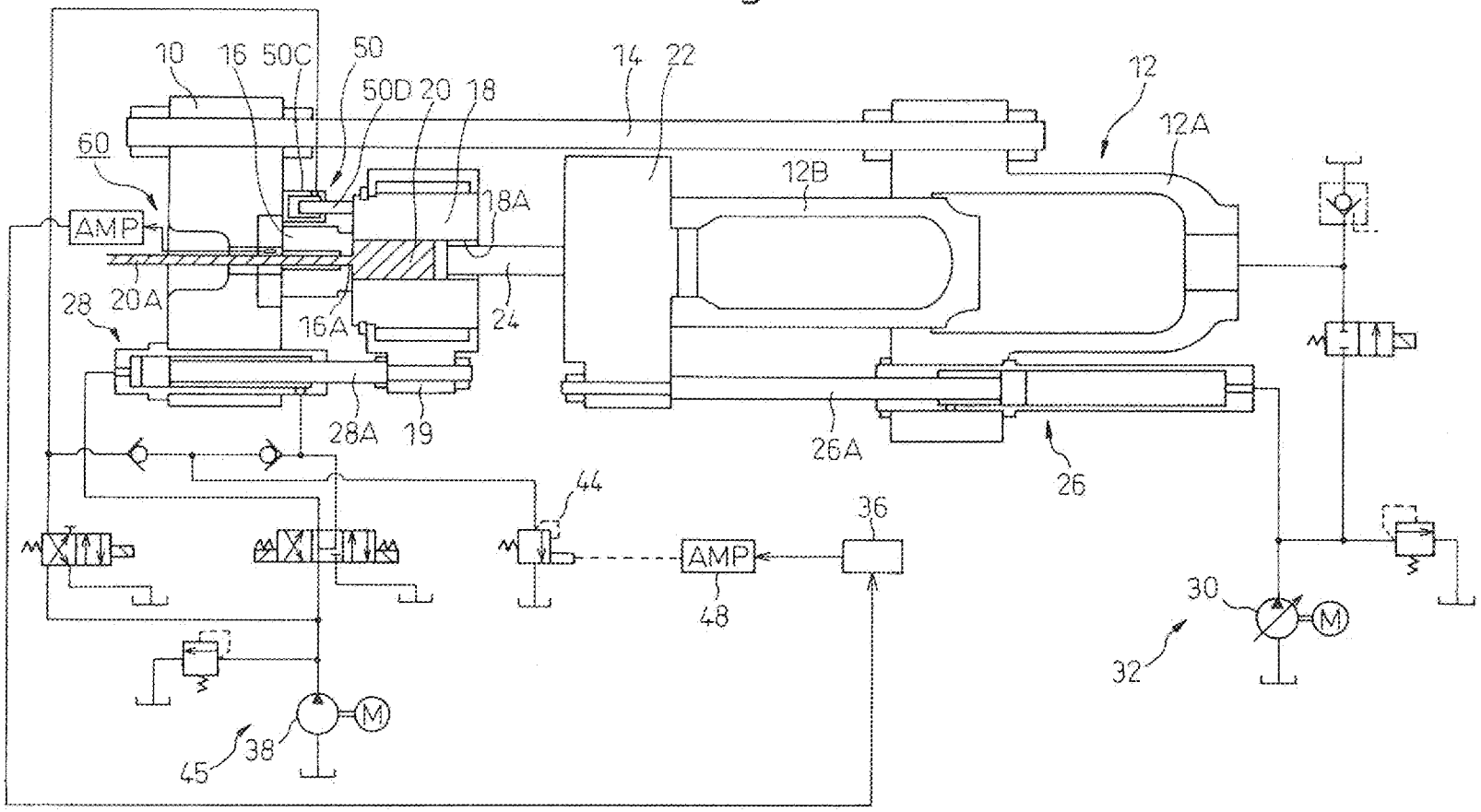
FIG. 9 is a section view of an extrusion press according to another embodiment.

FIG. 9 is a section view of an extrusion press showing another aspect with a configuration in which a hydraulic cylinder is used as the container drive means 50 in the aspect in FIG. 8. In FIG. 9, between the end platen 10 and the container 18, the hydraulic cylinder 50C is provided as the plurality of the container drive means 50 arranged so as to surround the die unit 16. The container shift cylinder device 28 and the hydraulic circuit 45 for driving the hydraulic cylinder 50C are provided, the hydraulic cylinder 50C is attached so that the direction in which the ram 50D extends is in parallel with the extrusion axis line of the extrusion press, the tip end of the ram 50D can come into contact with the end surface of the container 18 and the container 18 is pressed under pressure by the drive of the hydraulic cylinder 50C to generate a correction force. The control means of the drive means 50 in FIG. 9 comprises the controller 36 and the amplifier 48.

The action is different from that in FIG. 8 in the following points. That is, when the container sealing force is reduced, the controller 36 is input with a detection signal from the die deflection sensor 62 of the die deflection detection device 60 via an amplifier and stores the reference deflection amount δ1, which is a value used for comparison with a detected deflection amount, in the built-in memory. Then, the configuration is such that the deflection amounts detected in the extrusion process are input successively and the input deflection amount and the reference deflection amount δ1 are compared and mathematically processed.

When the mathematically processed deviation is minus, that is, when the deflection amount is smaller than the reference deflection amount δ1, it means that the container sealing force acts excessively, and therefore, the hydraulic pressure value Pc3 required to generate a correction force in accordance with the amount of excess and to be supplied to the hydraulic cylinder 50C is calculated. The pressure value Pc3 can be calculated by storing in advance the relationship between the extrusion force and the die deflection amount in the controller 36, then obtaining the extrusion force from the mathematically processed deviation, and dividing the extrusion force by the total section area of the main cylinder device 12 and the side cylinder device 26.

Then, voltage conversion processing corresponding to the calculated pressure value Pc3 is performed and its result is output to the amplifier 48 as an output signal, and thus the proportional electromagnetic relief valve 44 is controlled.

Figure 10:
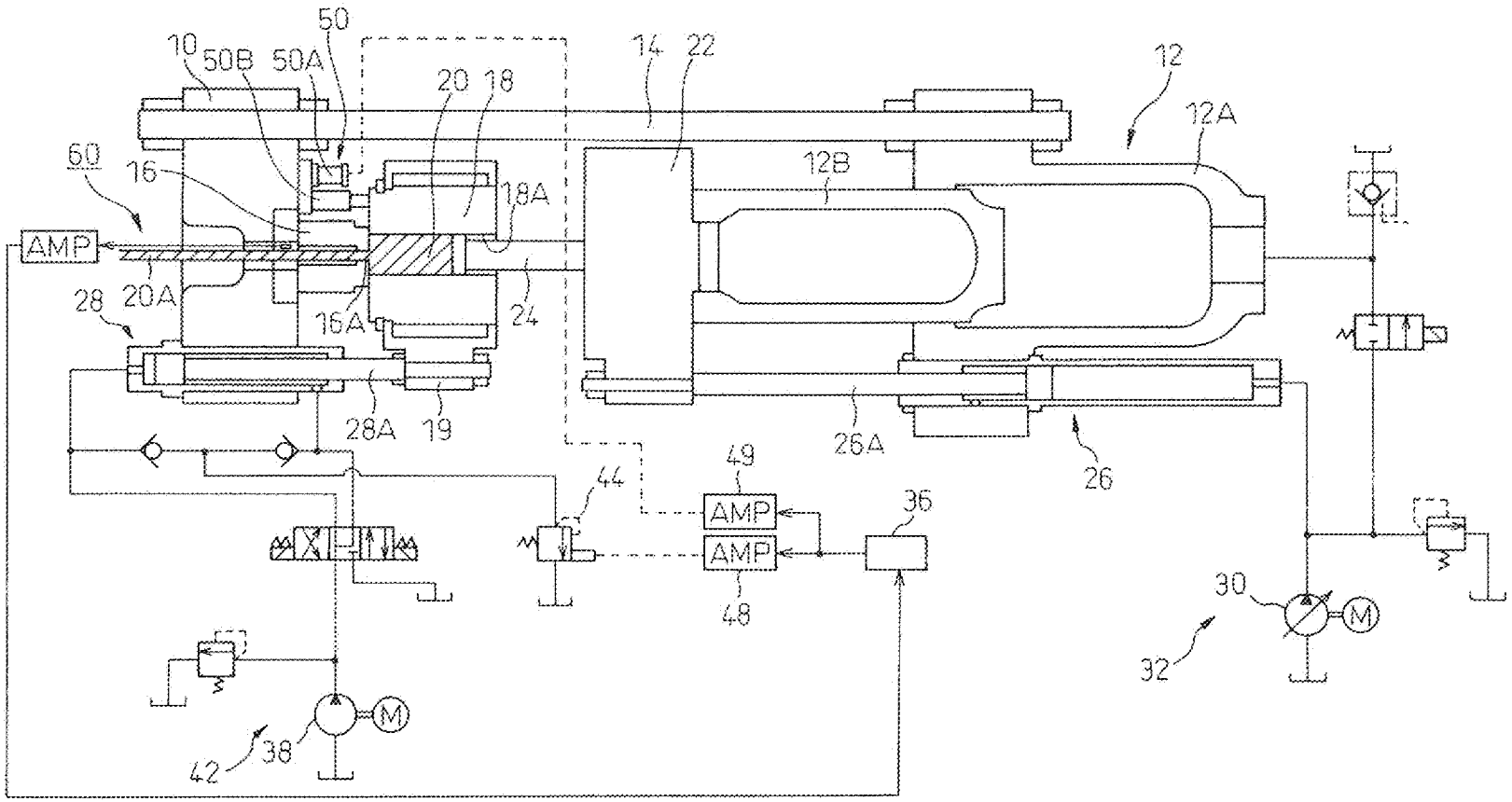
FIG. 10 is a section view of an extrusion press according to still another embodiment.

FIG. 10 shows a section view of an extrusion press according to still another embodiment and its configuration adopts both aspects in FIG. 6 and FIG. 7. The configuration is such that an output is sent to the moving means and the drive means of the container when reducing the container sealing force, and the amount of control to be output to the proportional electromagnetic relief valve 44 that controls the hydraulic pressure to be supplied to the head side of the container shift cylinder device 28 and the electric servomotor 50C is output to the amplifiers 48, 19, respectively, by the controller 36 in accordance with the reference determined in advance, and thus the container sealing force is corrected. The correction to increase the container sealing force makes use of the means to apply a predetermined hydraulic pressure to the rod side of the container shift cylinder device 28 described above.

Figure 11:
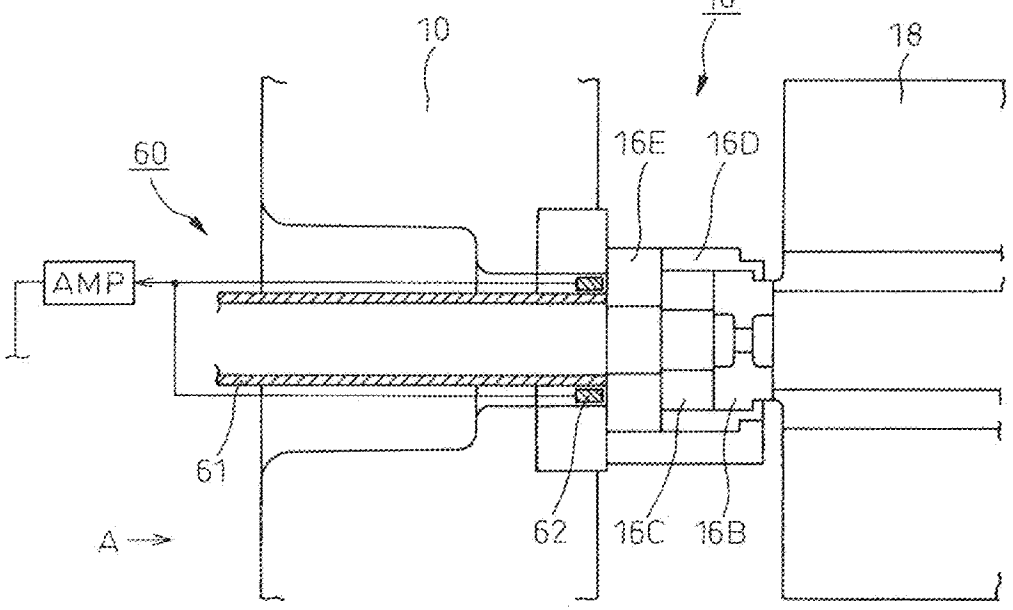
FIG. 11 shows a die deflection detection device, FIG. 11(*a*) showing its section view, and FIG. 11(*b*) showing a diagram along arrow A.
Figure 11:
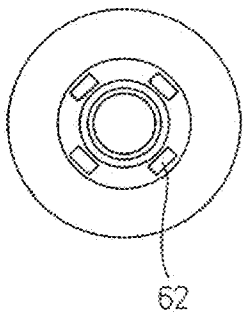

FIG. 11 is a section view showing essential parts of the die deflection detection device 60. In FIG. 11, reference number 16 denotes a die unit and the die unit basically comprises a die 16B, a die backer 16C, a die ring 16D, and a die bolster 16E supported by the end platen 10. The container is sealed by pressing under pressure the container 18 against the end platen 10 with the container shift cylinder device 28 and pressing under pressure the die 16B against the end platen 10 by a container liner, through the die backer 16C and the die bolster 16E.

After the container is sealed, the container 18 is loaded with a billet and the rear end surface of the billet is pressurized toward the die 16B side with a stem and a product is extruded from the die hole 16A.

When an extrusion force acts on the die unit 16, the die unit 16 deforms and deflects in the direction of extrusion accordingly. Then, the amount of deflection of the die unit 16 reduces in inverse proportion to the magnitude of the extrusion force that acts on the die unit 16.

The die deflection detection device 60 basically comprises a product guide 61 provided in a product discharge hole in the center of the end platen 10 to prevent deformation due to an extrusion force and a plurality of die deflection detection sensors 62 attached at the tip end part of the product guide 61. It is preferable to use a non-contact type displacement sensor, such as an eddy-current type, an optical type, and an ultrasonic type, as the die deflection detection sensor 62. In the present embodiment, the configuration is such that the four die deflection detection sensors 62 are used and the deflection of the die 16B is detected by the deflection of the die bolster 16E, and the respective deflection amounts are input to the controller 36 and the average of the input values is used as a detected amount.

Although the configuration is such that a non-contact type displacement sensor is used as the die deflection sensor 62, a configuration may be adopted, in which a plurality of non-contact type displacement sensors and a sensor that detects the magnitude of an acting force are used.

As explained above, the deflection amount of a die during extrusion process is detected and compared with a reference deflection amount set in advance and then mathematically processed, and when the deviation is smaller than the reference value, correction is made so as to reduce the container sealing force and when the deviation is larger than the reference value, correction is made so as to increase the container sealing force, and therefore, it is possible to keep constant the container sealing force in the extrusion process.

As a result, it is possible to keep constant the amount of deflection of the die unit 16, and therefore, to make uniform the thickness and shape of the extruded product 20A in the longitudinal direction, and to considerably increase the product yields.

In addition, it is possible to make constant the container sealing force that acts on the die unit 16 without increasing the load pressure of the main cylinder device 12 when correcting and keeping constant the container sealing force, and therefore, energy efficiency is improved and the amount of energy consumption can be reduced.

Furthermore, there is an excellent effect that the container sealing force can be kept constant during the extrusion process and can be kept to a desired container sealing force, and the occurrence of a burr caused by the bursting phenomenon from the sealing surface can be effectively prevented.

The amount of deformation and deflection of the end platen that is added when the correction force is caused to act on the container sealing force becomes small because the load is propagated to the end platen not from the die sealing end surface but via the container shift cylinder device and the moment that acts on the end platen is improved to be smaller, and therefore, the influence on the die unit works in a further better manner.

While the invention has been described by reference to specific embodiments chosen for the purposes of illustration, it should be apparent that numerous modifications could be made thereto, by those skilled in the art, without departing from the basic concept and scope of the invention.

What is claimed is:

1. An extrusion press comprising a container mover that moves a container at an end platen and molding a product by extruding a billet loaded in the container from a die by a stem of a main cylinder device, wherein:

a hydraulic pressure of the main cylinder device in an extrusion process is detected;

a deviation between the detected hydraulic pressure and a reference pressure set in advance is mathematically processed; and wherein the extrusion press comprises a controller, which is capable of sending an output to the container mover to reduce a container sealing force when the deviation is more than zero and the container sealing force exceeds an amount or container sealing force corresponding to the reference pressure, and to increase the container sealing force when the deviation is less than zero and the container sealing force is less than the amount or container sealing force corresponding to the reference pressure, so that a constant container sealing force corresponding to the reference pressure acts on an end surface of the die; and the reference pressure is set, before beginning the extrusion process, in a pressure range lower than a maximum extrusion load pressure and higher than a required extrusion load pressure that acts on the die.

2. An extrusion press comprising a container mover that moves a container at an end platen and molding a product by extruding a billet loaded in the container from a die by a stem of a main cylinder device, wherein:

a container driver that reduces a pressing force that acts on an end surface of the die by pushing and moving the container in a direction away from the die is provided at the end platen;

a hydraulic pressure of the main cylinder device in an extrusion process is detected;

a deviation between the detected hydraulic pressure and a reference pressure set is mathematically processed; and wherein the extrusion press comprises a controller capable of sending an output to the container drive means to reduce a container sealing force when the deviation is more than zero plus and the container sealing force exceeds an amount or container sealing force corresponding to the reference pressure and a controller capable of sending an output to the container mover to increase the container sealing force when the deviation is less than zero and the container sealing force is less than the amount or container sealing force corresponding to the reference pressure, so that a constant container sealing force corresponding to the reference pressure acts on an end surface of the die.

3. The extrusion press according to claim 2, wherein the container driver provided at the end platen to reduce a container sealing force that acts on an end surface of a die comprises a hydraulic cylinder.

4. An extrusion control method wherein a container mover capable of freely moving a container back and forth with respect to an end platen and acting container sealing force by pressing a die through the container is provided and a product is molded by extruding a billet loaded in the container from a die by a stem of a main cylinder device comprising steps of:

detecting a hydraulic pressure of a main cylinder device in an extrusion process of an extrusion press;

mathematically processing a deviation between the detected hydraulic pressure and a reference pressure set in advance; and performing a constant pressure extrusion by sending an output to a container mover to reduce a container sealing force when the deviation is more than zero and the container sealing force exceeds an amount or container sealing force corresponding to the reference pressure, and to increase the container sealing force when the deviation is less than zero and the container sealing force is less than the amount or container sealing force corresponding to the reference pressure, so that a constant container sealing force corresponding to the reference pressure acts on an end surface of a die; and the reference pressure is set, before beginning the extrusion process, in a range lower than a maximum extrusion load pressure and higher than a required extrusion load pressure that acts on the die.

5. An extrusion control method wherein a container mover capable of freely moving a container back and forth with respect to an end platen and acting container sealing force by pressing a dig through the container and a container driver that reduces a pressing force that acts on an end surface of the die by moving the container in a direction away from the die are provided on the end platen, and a product is molded by extruding a billet loaded in the container from a die by a stem of a main cylinder device comprising steps of:

detecting a hydraulic pressure of a main cylinder device in an extrusion process of an extrusion press;

mathematically processing a deviation between the detected hydraulic pressure and a reference pressure set in advance; and performing a constant pressure extrusion by sending an output to a container driver to reduce a container sealing force when the deviation is more than zero pressure and the container sealing force exceeds an amount or container sealing force corresponding to the reference pressure, and by sending an output to a container mover to increase the container sealing force when the deviation is less than zero and the container sealing, force is less than the amount or container sealing force corresponding to the reference pressure, so that a constant container sealing force corresponding to the reference pressure acts on an end surface of a die.

6. An extrusion control method wherein a container mover capable of freely moving a container back and forth with respect to an end platen and acting container sealing force by pressing a die through the container and a container driver that reduces pressing force that acts on an end surface of the die by pushing and moving the container in a direction away from the die are provided on the end platen, and a product is molded by extruding a billet loaded in the container from a die by a stem of a main cylinder device comprising steps of:

detecting a hydraulic pressure of a main cylinder device in an extrusion process of an extrusion press;

mathematically processing a deviation between the detected hydraulic pressure and a reference pressure set in advance; and performing a constant pressure extrusion by sending an output to a container mover and a container driver to reduce a container sealing force when the deviation is more than zero and the container sealing force exceeds an amount or container sealing force corresponding to the reference pressure, and by sending an output to the container mover to increase the container sealing force when the deviation is less than zero and the container sealing force is less than the amount or container sealing force corresponding to the reference pressure, so that a constant container sealing force corresponding to the reference pressure acts on an end surface of a die.

7. The extrusion press according to claim 2, wherein the container driver provided at the end platen to reduce the container sealing force that acts on the end surface of the die comprises an electric servomotor and a ball screw converter including a screw shaft and a ball nut to convert a rotational motion of an output shaft of the electric servomotor into a linear motion.

* * * * *